US006428373B2

(12) United States Patent
Ikuma et al.

(10) Patent No.: US 6,428,373 B2
(45) Date of Patent: Aug. 6, 2002

(54) VENTILATION COVER STRUCTURE FOR OUTBOARD ENGINE PROVIDED WITH FOUR-STROKE CYCLE ENGINE

(75) Inventors: Tomonori Ikuma; Hiroyuki Yoshida, both of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/756,496

(22) Filed: Jan. 8, 2001

(30) Foreign Application Priority Data

Jan. 14, 2000 (JP) ..... 2000-006534
Dec. 20, 2000 (JP) ..... 2000-387930

(51) Int. Cl.[7] ..... B63H 20/32
(52) U.S. Cl. ..... 440/77
(58) Field of Search ..... 440/76, 77, 88, 440/900; 123/195 P, 195 C

(56) References Cited

U.S. PATENT DOCUMENTS 4,692,123 A * 9/1987 Tada et al. ..... 440/77
4,968,276 A * 11/1990 Hashimoto ..... 440/77
5,683,277 A * 11/1997 Tsunoda et al. ..... 440/80
5,713,772 A * 2/1998 Takahashi et al. ..... 440/78
5,722,360 A * 3/1998 Tsunoda et al. ..... 123/195 P
5,829,402 A * 11/1998 Takahashi et al. ..... 123/184.24
5,873,755 A * 2/1999 Takahashi et al. ..... 440/77

FOREIGN PATENT DOCUMENTS

JP 59-10093 1/1984
JP 8-100647 4/1996

* cited by examiner

*Primary Examiner*—S. Joseph Morano
*Assistant Examiner*—Ajay Vasudeva
(74) *Attorney, Agent, or Firm*—Carrier, Blackman & Associates, P.C.; Joseph P. Carrier; William D. Blackman

(57) ABSTRACT

A cover structure (50) in an outboard engine (1) having an engine (2) with an engine block (8), a vertical crankshaft (7) and a vertical camshaft (15) having upper end portions projecting upward from the engine block, a timing belt (17) extended between upper ends of the crankshaft and the camshaft, and a flywheel (12*a*) disposed on the upper end portion of the crankshaft (7). The ventilation cover structure (50) comprises a first cover (60) disposed above the engine block (8) so as to cover at least the flywheel (12*a*) and opening downward, and a second cover disposed above the engine block (8) so as to cover a space extending over a portion of the engine block (8) including the camshaft (15) and opening downward. The first and the second covers (60, 80) are joined together so that spaces covered with the first and the second covers (60, 80) are united in a single space. A discharge duct (90) is formed on at least either the first cover (60) or the second cover (80) so as to lie outside a space occupied by the flywheel (12*a*) on a level above that of the timing belt (17).

18 Claims, 23 Drawing Sheets

VENTILATION COVER STRUCTURE FOR OUTBOARD ENGINE PROVIDED WITH FOUR-STROKE CYCLE ENGINE

BACKGROUND OF THE INVENTION

1. Field of the Invention

The present invention relates to a ventilation cover structure for an outboard engine provided with a four-stroke cycle engine and which detachably clamps to the transom of a boat to propel the boat. More particularly, the present invention relates to a ventilation cover structure for an outboard engine provided with a four-stroke cycle engine, which improves the performance of the four-stroke cycle engine by discharging hot air heated by the four-stroke cycle engine from the engine room of the outboard engine.

2. Description of the Related Art

An outboard engine has an engine disposed in an enclosed engine room to make it difficult for water to leak into the intake system of the engine and to wet the engine. Consequently, hot air is liable to stagnate in the engine room and the hot air tends to reduce the output of the engine because the hot air raises the temperature of intake air.

Hot air discharging means for effectively discharging hot air heated by heat generated by the engine outside the engine room are disclosed in JP-A Nos. Sho 59-10093 and Hei 8-100647 to solve the foregoing problem. These known hot air discharging means are intended for application to outboard engines provided with a four-stroke cycle engine, and the hot air discharging means serves also as a cover extended over the engine to cover a timing belt for driving valves and to prevent the engine from being wetted with water. Particularly, the hot air discharging means disclosed in JP-A No. Hei 8-100647 ventilates the engine room positively by using a ventilation cover to suppress the rise of the temperature of intake air. This is done by discharging not only hot air heated by the engine, but also by stagnating around the walls of the engine disposed directly below the ventilation cover outside the engine room. Each of those known hot air discharging means uses a ventilation duct formed of an upper cover extended over and covering rotating members respectively having large diameters, such as a flywheel and a crank pulley mounted on the crankshaft of the engine, and a lower cover extended under and covering the same rotating members. This ventilation duct places restrictions on an engine assembling procedure. The upper cover is a single, large structure formed of a resin and covering a wide space extending from a region around the camshaft of the engine to a region around the crankshaft of the engine. Therefore, a large mold is necessary to form the upper cover, which increases the cost of the ventilation duct.

SUMMARY OF THE INVENTION

Accordingly, it is an object of the present invention to solve the foregoing problems in the known ventilation cover structures for an outboard engine provided with a four-stroke cycle engine; and to specifically provide a ventilation cover structure for an outboard engine having a four-stroke cycle engine, which does not place any restriction on an engine assembling procedure, is formed of small component parts and capable of being formed at low manufacturing costs, and achieves a satisfactory ventilating function.

According to one aspect of the present invention, a ventilation cover structure for an outboard engine provided with a four-stroke cycle engine having an engine block, a vertical crankshaft having an upper end portion projecting upward from the engine block, a vertical camshaft having an upper end portion projecting upward from the engine block, a belt-drive transmission mechanism including a camshaft driving pulley mounted on the upper end portion of the crankshaft, a camshaft pulley mounted on the upper end portion of the camshaft, and a belt extended between the camshaft driving pulley and the camshaft pulley to interlock the crankshaft and the camshaft, and a flywheel disposed above the camshaft driving pulley and mounted on the upper end portion of the crankshaft; and engine covers defining an engine room in which the four-stroke cycle engine is disposed comprises: a first cover disposed above the engine block so as to cover at least the flywheel and opening downward; and a second cover disposed above the engine block so as to cover a space extending over a portion of the engine block on the side of the camshaft and opening downward; wherein the first and the second covers are united together so that spaces covered with the first and the second covers are united in a single space, and sections of the first and the second covers lying outside a space occupied by the flywheel jointly form a discharge duct defining a space communicating with the single space covered with the first and the second covers.

Since the ventilation cover structure in the above aspect of the present invention for covering the space over the engine block of the four-stroke cycle engine of the outboard engine in which the crankshaft and the camshaft project upward from the engine block, i.e., a vertical four-stroke cycle outboard engine, comprises the first cover covering at least the flywheel mounted on an upper end portion of the crankshaft, and the second cover covering the space extending over the portion of the engine block on the side of the camshaft, water leaked in an upper region of the engine room over the vertical four-stroke cycle engine can be prevented from falling on the belt-drive transmission mechanism and the flywheel.

Since the ventilation cover structure of the present invention does not cover the belt-drive transmission mechanism and the flywheel from below, the component parts of the belt-drive transmission mechanism and the flywheel do not need to be removed when incorporating the ventilation cover structure into the four-stroke cycle engine, and the ventilation cover structure including the first and the second covers can be very simply and easily attached to the four-stroke cycle engine provided with the belt-drive transmission mechanism and the flywheel.

Since the ventilation cover structure of the invention, capable of entirely covering a space over the four-stroke cycle engine is divided into the first and the second covers, each of which is smaller than the entire ventilation cover structure, the first and the second covers can be formed by molding using relatively small molds, which enables the manufacture of the ventilation cover structure at a comparatively low manufacturing cost.

Hot air heated by the four-stroke cycle engine and stagnating around the engine block and the belt-drive transmission mechanism can be surely collected by the first and the second covers opening downward, and is discharged through the discharge duct upward from the ventilation cover structure. Thus, the ventilation cover structure exercises a satisfactory ventilating function, which enhances the output of the four-stroke cycle engine.

Since the discharge duct is formed by overlapping portions of the first and the second covers, lying outside a space occupied by the flywheel so as to define a space communicating with the single space defined by the first and the second covers, a space extending over the engine block can be effectively used and the discharge duct has a high discharging ability.

Each of the first and the second covers may be formed by molding using a split mold that can be split along a parting face into an upper half mold and a lower half mold. Thus the first and the second covers can be produced at a high productivity and at a low cost.

Each of the first and the second covers may be formed by molding using a mold that can be split along a horizontal parting plane into an upper half mold and a lower half mold in a molding of a shape that can be easily removed from the mold. Thus, the first and the second covers can be produced at a high productivity and at a low cost.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
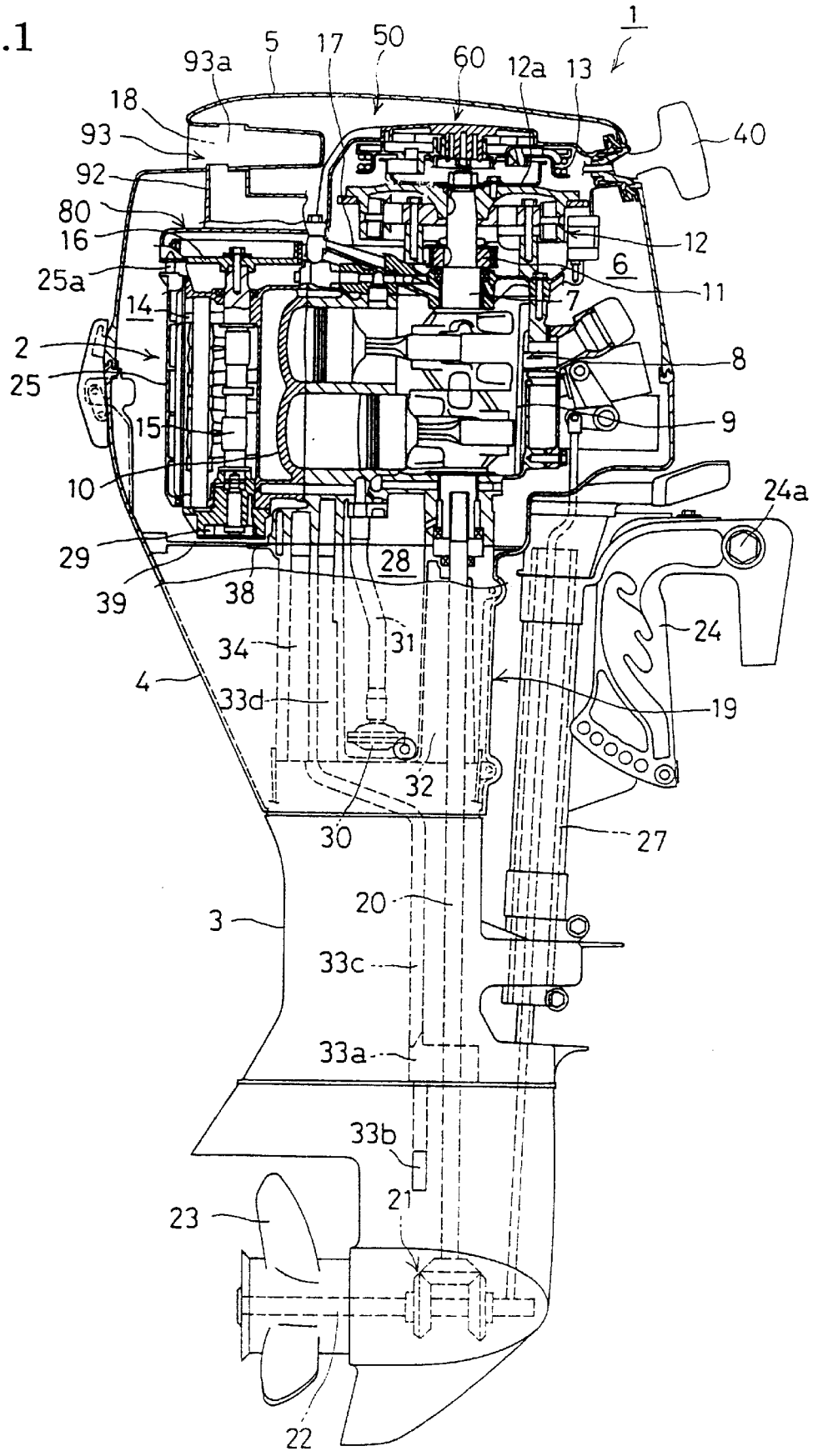
FIG. 1 is a longitudinal sectional view of an outboard engine including a four-stroke cycle engine provided with a ventilation cover structure in a first embodiment according to the present invention.

FIG. 1 shows an outboard engine 1 including a four-stroke cycle engine 2 (hereinafter referred to simply as "engine") provided with a ventilation cover structure 50 in a first embodiment according to the present invention. In FIG. 1, the right side is corresponds to the front side of the outboard engine 1 contiguous with the stern of a boat. The outboard engine 1 has an extension case 3, an under cover 4 joined to the upper end of the extension case 3, and a cowling 5 detachably joined to the upper end of the under cover 4. An expanded upper portion of the under cover 4 and the cowling 5 define an engine room 6. The engine 2 of the outboard engine 1 has an engine block 8 supporting a crankshaft 7 and a camshaft 15 in a vertical position and engine accessories. The engine 2 and the engine accessories are placed in the engine room 6. The engine block 8 is provided with two cylinders formed in a vertical arrangement. A crankcase 9 is attached to the front surface, i.e., the right surface as viewed in FIG. 1, of the engine block 8, and a cylinder head 10 is attached to the back surface, i.e., the left surface as viewed in FIG. 1, of the engine block 8. In FIG. 1, pistons fitted in the upper and the lower cylinder of the engine block 8 are at the top dead center and the bottom dead center, respectively. Thus, the phase difference between the two pistons is 360°. A camshaft driving pulley 11, a rotor 12*a* included in an ac generator 12, a starter pulley included in a recoil starter 13 are mounted and arranged upward in that order on an upper end portion of the crankshaft 7 projecting upward from the engine block 8. The rotor 12*a* of the ac generator 12 serves also as a flywheel.

A camshaft 15 is disposed in a cam chamber 14 formed behind the cylinder head 10 (on the left side as viewed in FIG. 1). A camshaft pulley 16 is mounted on an upper end portion of the camshaft 15 projecting upward from the engine block 8. A timing belt 17 is extended between the camshaft driving pulley 11 and the camshaft pulley 16 to form a belt-drive transmission mechanism. The camshaft 15 is rotated at a rotating speed half that of the crankshaft 7 that rotates in a clockwise direction as viewed in FIG. 2.

A valve mechanism, not shown, driven by the camshaft 15 is disposed in the cam chamber 14. The camshaft 15 drives the cam mechanism of drive inlet valves for opening and closing inlet ports, and exhaust valves for opening and closing exhaust ports. Combustion air is taken into the engine room 6 through a combustion air inlet opening 18 formed in an upper rear portion of the cowling 5. Engine cooling water is sucked through a suction opening formed near the lower end of the extension case 3.

The engine 2 of the outboard engine 1 having the engine block 8 and the engine accessories is fixed to the upper end of an oil case 19 disposed under the engine block 8. Substantially the entire weight of the engine 2 is born by the oil case 19. The oil case 19 is formed of an aluminum alloy by die casting and has a high rigidity. The oil case 19 is firmly fixed to the upper end of the extension case 3. The extension case is formed of an aluminum alloy by die casting and has a high rigidity.

The lower end of the crankshaft 7 is coupled with a driving shaft 20. The driving shaft 20 extends downward through the extension case 3 and is interlocked with a propeller shaft 22 by a bevel-gear-and-dog-clutch type reversing mechanism 21. A propeller 23 is mounted on a free end portion of the propeller shaft 22. The rotation of the crank shaft 7 is transmitted through the driving shaft 20, the bevel-gear-and-dog-clutch type reversing mechanism 21 and the propeller shaft 22 to the propeller 23.

The outboard engine 1 is supported on a bracket 24 to be clamped to the stern of a boat by a swivel shaft 27 supported on the bracket 24 by a horizontal tilt shaft 24*a*. Thus, the outboard engine 1 can be turned on the swivel shaft 27 for steering and can be tilted on the horizontal tilt shaft 24*a*.

The oil case 19 has a case body provided with a central oil reservoir 28. A quantity of oil in a predetermined range of quantity is contained always in the oil reservoir 28. An oil pump 29 pumps up the oil through a strainer 30 and a suction pipe 31 and supplies the oil by pressure through an oil filter, not shown, to the sliding portions of the components of the engine 2. After lubricating the sliding portions, the return oil flows down into the oil reservoir 28. The rotor of the oil pump 29 is connected to the lower end of the camshaft 15. The camshaft 15 drives the rotor of the oil pump 29 for rotation. A middle portion of the oil case 19 is provided on the front side (right side as viewed in FIG. 1) of the oil reservoir 28 with a cavity 32 and the driving shaft 20 is extended through cavity 32. A cooling water supply pipe 33*c* included in an engine cooling system is extended vertically and a cooling water discharging passage 33*d* is formed vertically in a portion of the oil case 19 on the back side (left side as viewed in FIG. 1) of the oil reservoir 28. Indicated at 33*a* is a water pump and at 33*b* is a water inlet opening into water. An exhaust passage 34 for exhausting the exhaust gas discharged from the engine 2 is formed behind the cooling water discharging passage 33*d*. The exhaust gas flows downward through the exhaust passage 34 and the extension case 3 and flows through an discharge opening formed in a lower portion of the outboard engine 1 into water.

The edge of a flange 38 formed in an upper portion of the oil case 19 is joined to the inner peripheral edge of a partition wall 39 extending from the inner surface of the under cover 4. The partition wall 39, the flange 38 of the oil case 19 separates the engine room 6 from a space extending between the partition wall 39 and the flange 38, and the upper end of the extension case 3, and surrounded by a lower narrow portion of the under cover 4.

A first cover 60 opening downward is disposed above a portion of the engine block 8 on the side of the crankshaft 7 so as to cover the ac generator 12 and the starter pulley of the recoil starter 13. The lower edge of the first cover is on a level below that of the lower end of the camshaft driving pulley 11. A second cover 80 opening downward is disposed above a portion of the engine block 8 on the side of the camshaft 15 so as to cover the camshaft pulley 16. The first cover 60 and the second cover 80 are united together so that spaces defined by the first cover 60 and the second cover 80 are united in a single continuous space to form a ventilation cover structure 50 in a first embodiment according to the present invention. The ventilation cover structure 50 covers the timing belt 17 entirely. The first cover 60 and the second cover 80 are formed, for example, of an FRP (fiber-reinforced plastic) by using molds. The first cover 60 and the second cover 80 may be formed of a light alloy by die casting. The ventilation cover structure 50 is provided with a discharge duct 90 at least in either the first cover 60 or the second cover 80. In this embodiment, the discharge duct 90 is formed in the second cover 80. The discharge duct 90 has a lower wall extending on a level above that of the timing belt 17 in a region outside a space in which the rotor 12*a* of the ac generator 12 serving as a flywheel rotates.

Figure 2:
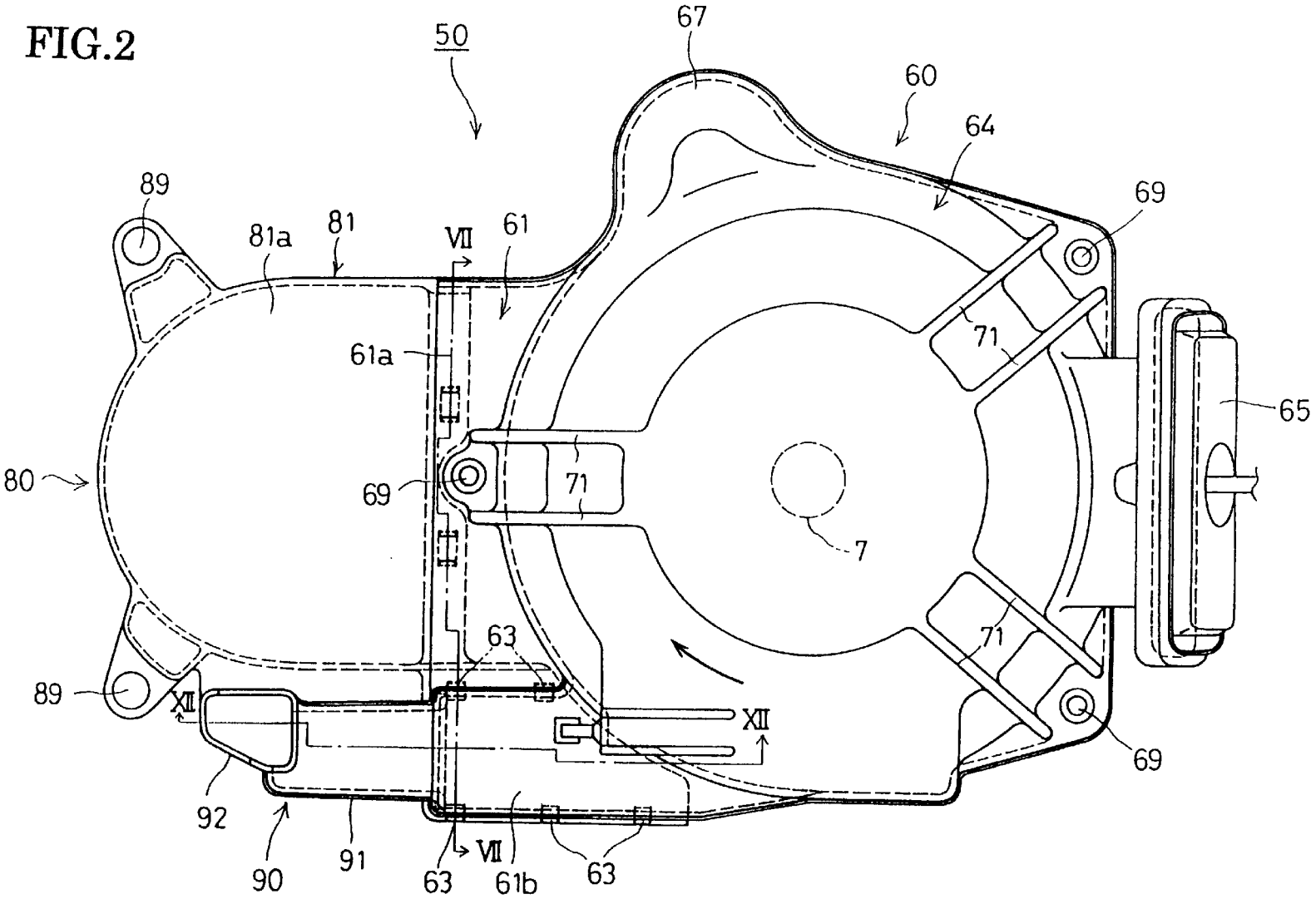
FIG. 2 is a plan view of the ventilation cover structure shown in FIG. 1.
Figure 3:
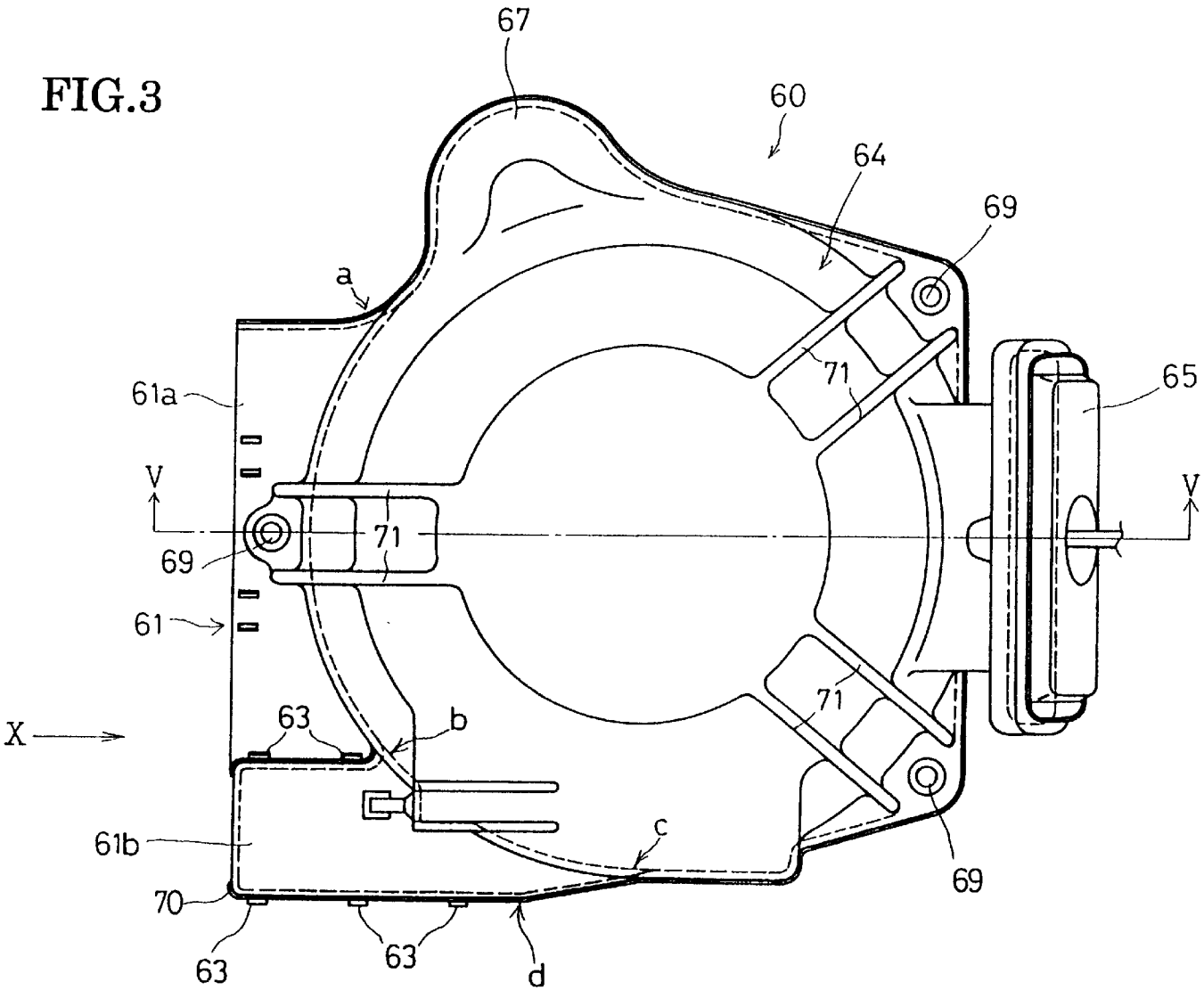
FIG. 3 is a plan view of a first cover included in the ventilation cover structure shown in FIG. 1.
Figure 4:
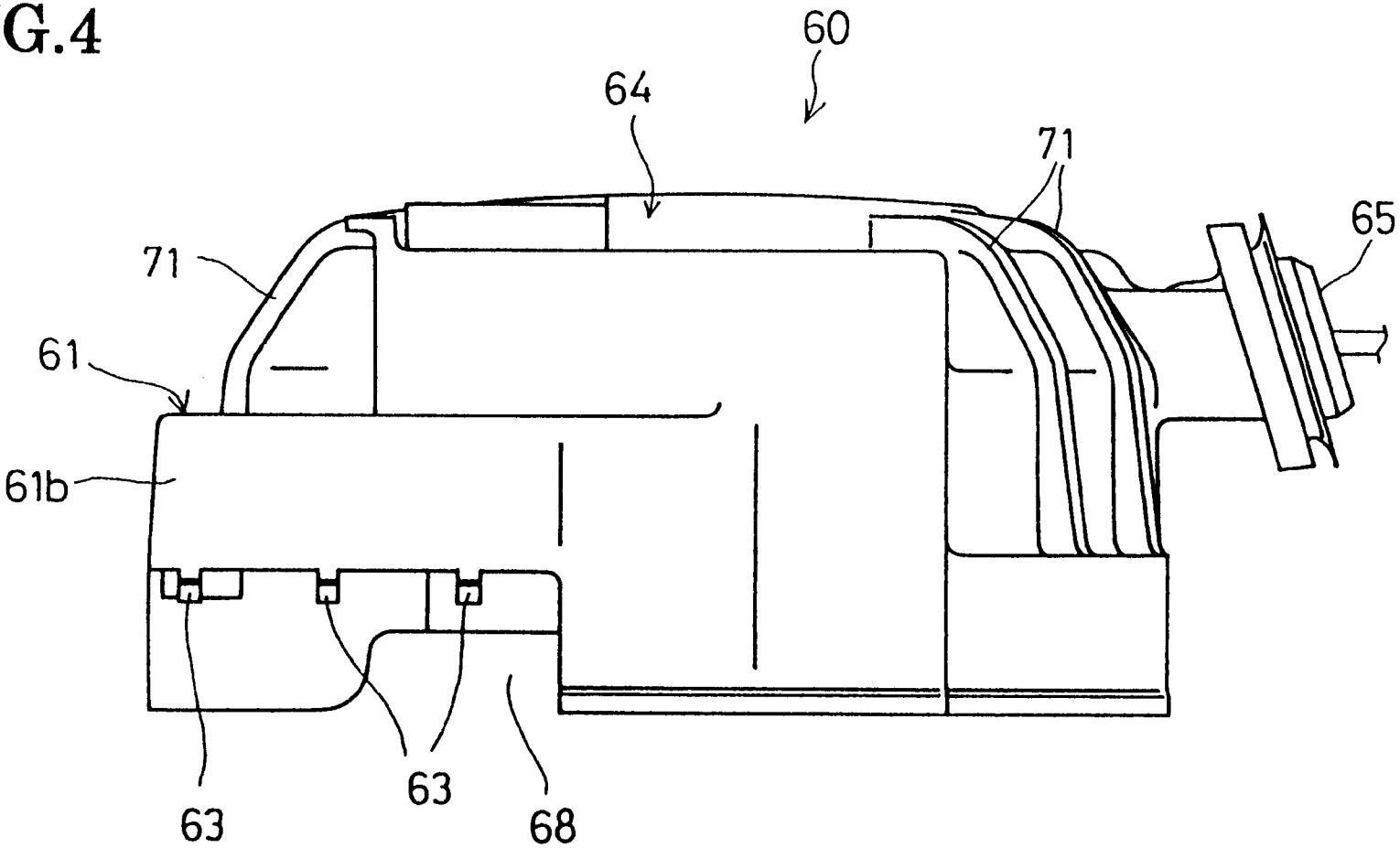
FIG. 4 is a side view of the first cover shown in FIG. 3 as viewed from the right side of the same.
Figure 5:
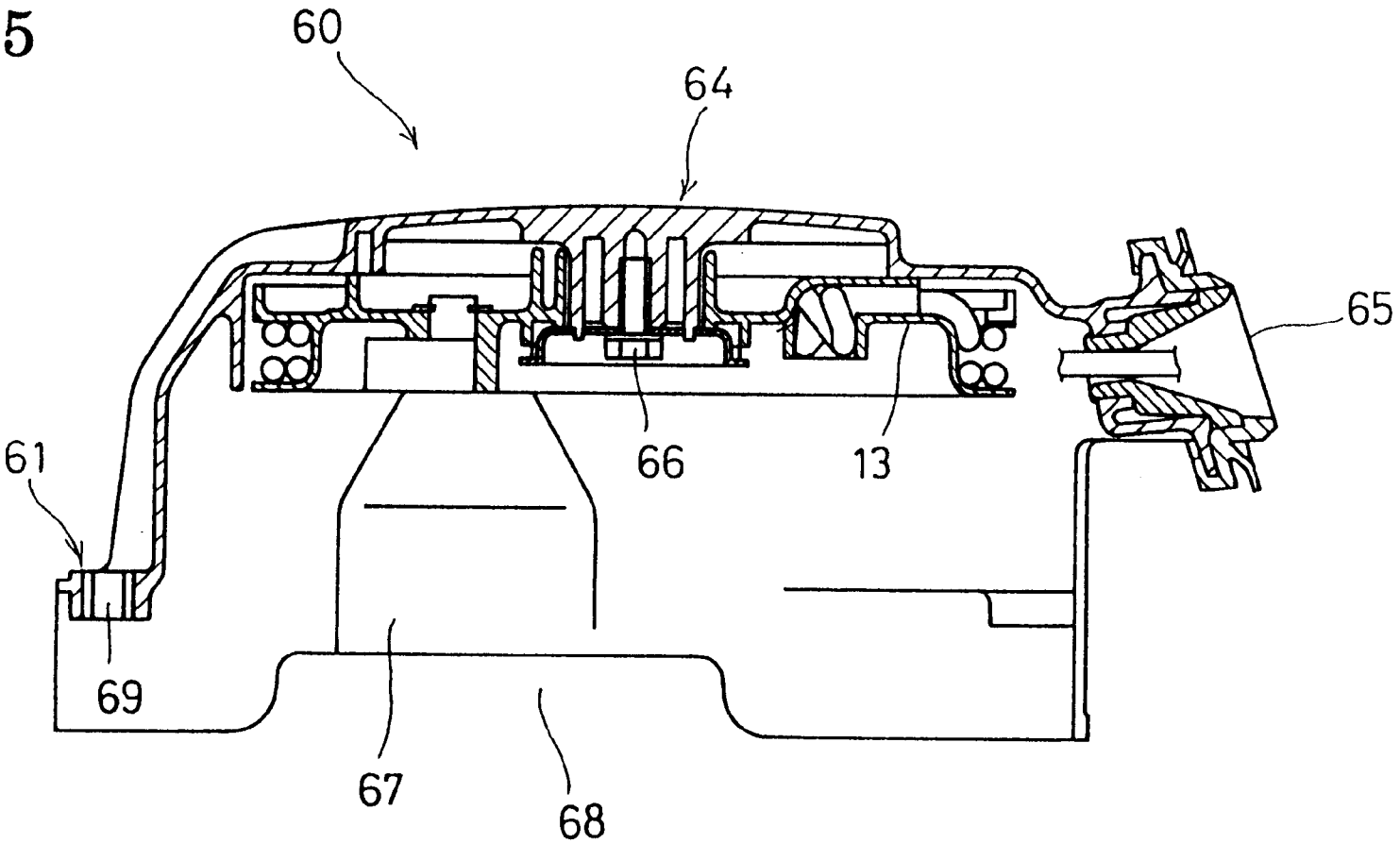
FIG. 5 is a sectional view taken on line V—V in FIG. 3.
Figure 6:
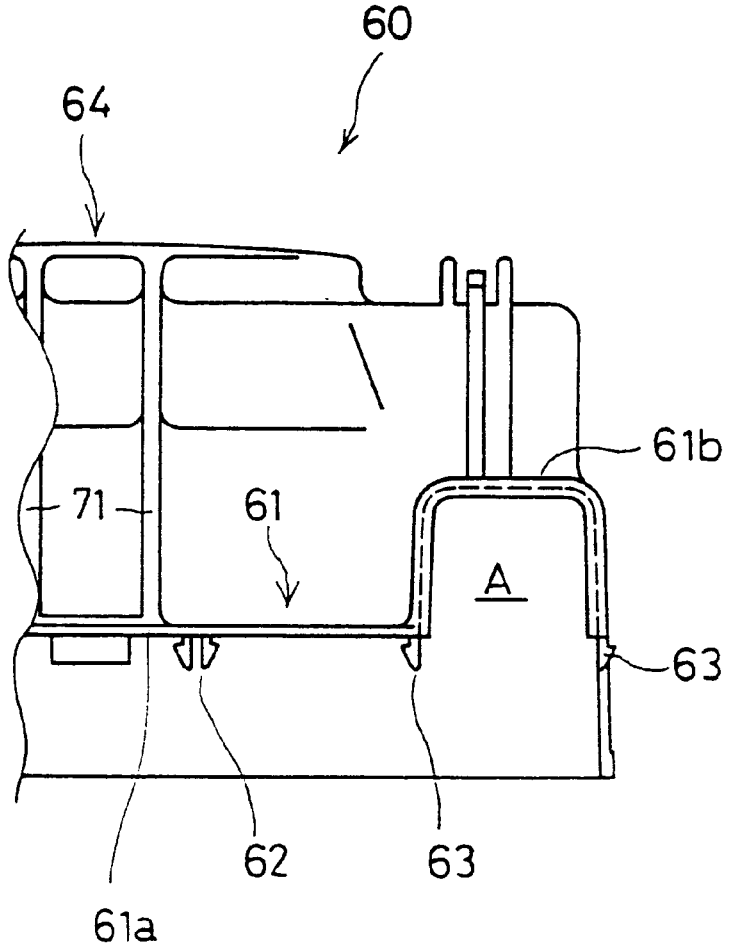
FIG. 6 is a partial front view taken in the direction of the arrow X in FIG. 3.
Figure 7:
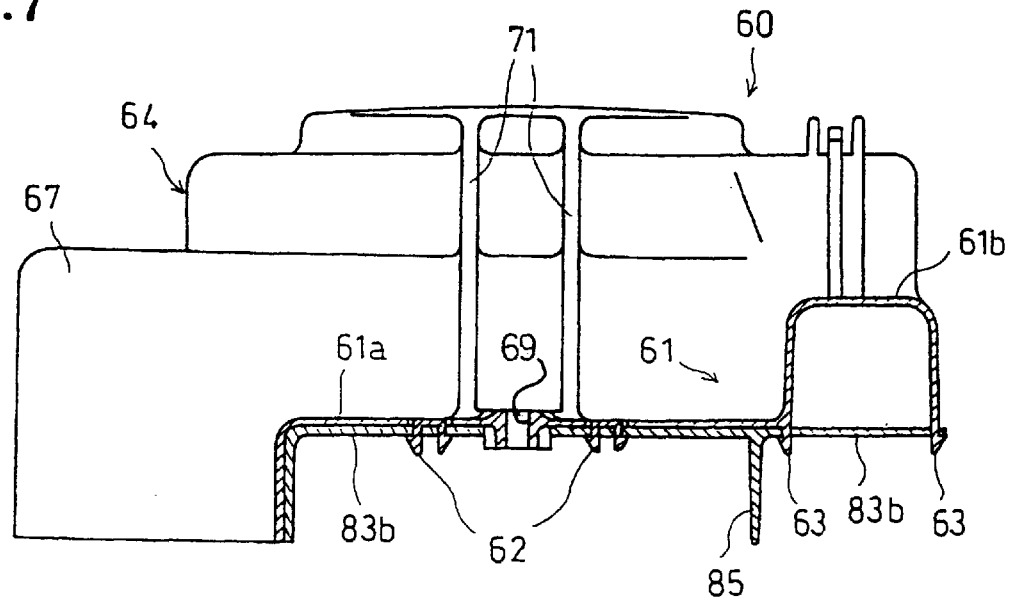
FIG. 7 is a sectional view taken on line VII—VII in FIG. 2.

The ventilation cover structure 50 will be described in detail. First, first cover 60 will be described with reference to FIGS. 2 to 7. The first cover 60 has a shape substantially resembling an inverted round bowl as shown in FIGS. 2 to 5. A back portion of the side wall of the first cover 60, extending in an angular range of about ⅜ of a circle between points a and c (see FIG. 3)is recessed as shown in FIGS. 4 to 7 to form a back opening. The depth of a section of the back opening corresponding to an angular range between the point a and a point b is about ⅓ of the depth of the first cover 60, and the depth of another section of the back opening corresponding to an angular range between the points b and c is about ⅔ of the depth of the first cover 60. A back extension wall 61 extends backward from the upper brim of the back opening of the first cover 60 as shown in FIGS. 6 and 7. The back extension wall 61 is fastened to the second cover 80. The back extension wall 61 has a low section 61*a* merging into a part of the upper edge of the back opening, between the points a and b and a side edge of the back opening, and a high section 61*b* merging into a part of the upper edge of the back opening, between the points b and c and side edges. The back edges of the low section 61*a* and the high section 61*b* are included in a vertical plane perpendicular to a longitudinal axis parallel to the axis of the propeller shaft 22. The low section 61*a* has a flat upper surface. As shown in FIGS. 3, 5 and 7, the lower section 61*a* is provided at its middle position with a hole 69 through which a bolt for fastening the first cover 60 to the engine block 8 is passed and at two positions on the opposite sides of the hole 69 with latching projections 62 projecting downward so as to engage the second cover 80. A lower half of a portion of the outer sidewall of the high section 61*b*, extending between the back end of the outer side wall and a position d on the outer side wall (FIGS. 3 and 4) is removed to form a recess. The depth of the recess is equal to the height of the side wall of the low section 61*a*. Thus, the high section 61*b* has a cross section of a shape resembling the inverted letter U and defines a passage A. A plurality of latching projections 63 project downward from the lower edges of the opposite side walls of the high section 61*b*. More concretely, three latching projections 63 project downward from the lower edge of the outer side wall and two latching projections 63 project from the lower edge of the inner side wall.

A handle holding portion 65 for holding an operating handle 40 for operating the recoil starter 13 is formed in a front end portion of a body 64 of the first cover 60, i.e., a main portion of the first cover 60 excluding the back extension wall 61. The starter pulley of there coil starter 13 is held detachably and rotatably on the body 64 by a bolt 66 screwed in a boss formed in a central portion of the back surface of the body 64. The first cover 60 is provided at positions on the opposite sides of the handle holding portion 65 with holes 69 through which bolts are passed to fasten the first cover 60 to the engine block 8. Three bolts are passed through the hole 69 formed in the back extension wall 61 and the two holes 69 formed in the body 64 and screwed in the engine block 8 to fasten the first cover 60 to the engine block 8. Three pairs of radial ribs 71 are formed in three portions corresponding to the three holes 69, respectively, of the outersurface of the body 64. A portion of the left side wall (upper side wall as viewed in FIG. 3) of the body 64 is protruded radially outward to form a bulged section 67 for receiving a drive pinion mounted on the output shaft of a starter motor, not shown. A lower portion of the bulged section 67 is recessed to form an air inlet 68.

Figure 8:
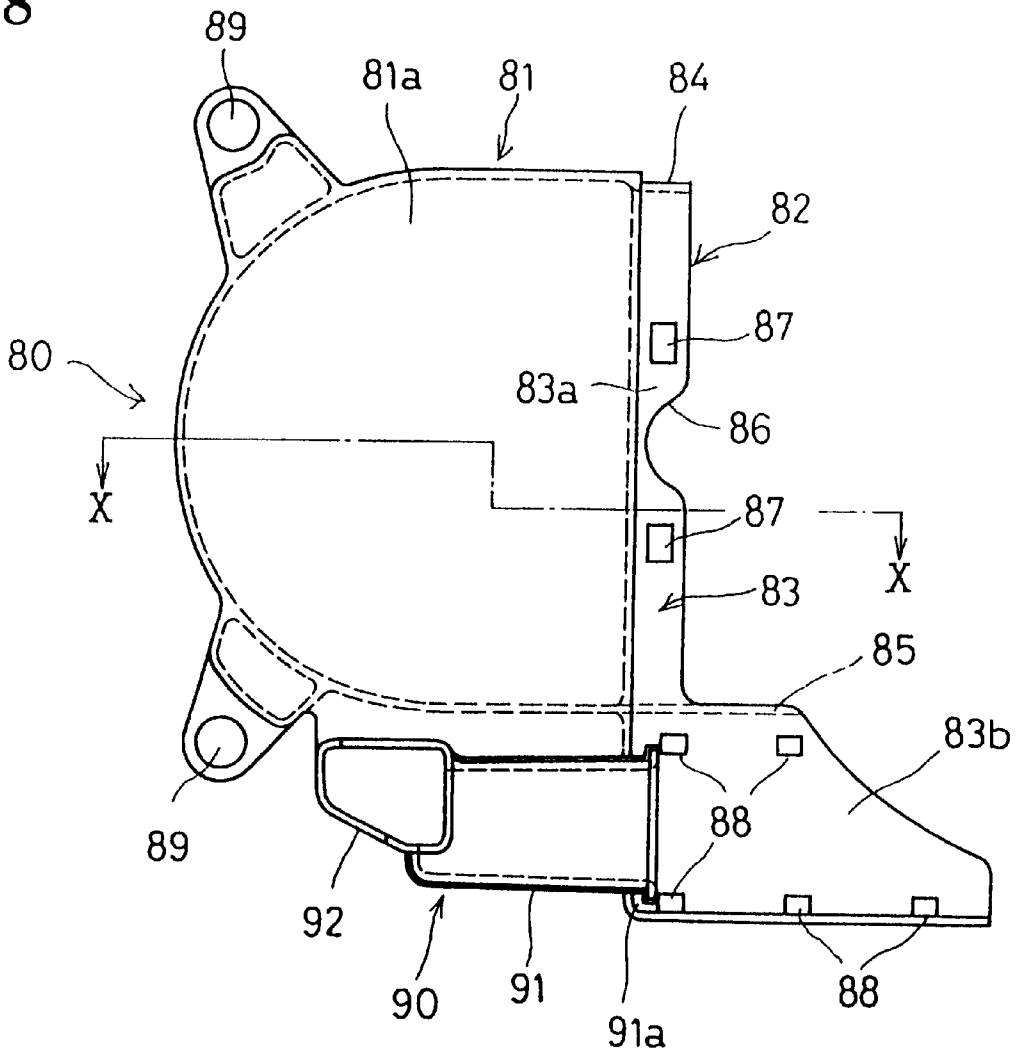
FIG. 8 is a plan view of a second cover included in the ventilation cover structure shown in FIG. 1.
Figure 9:
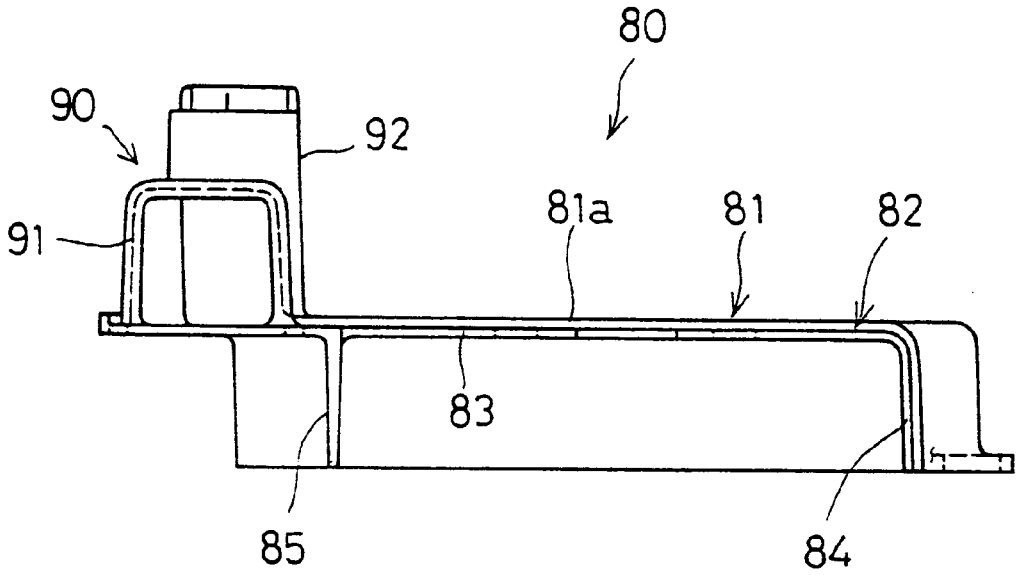
FIG. 9 is a side elevation of the second cover shown in FIG. 8 as viewed from the right side of the same.
Figure 10:
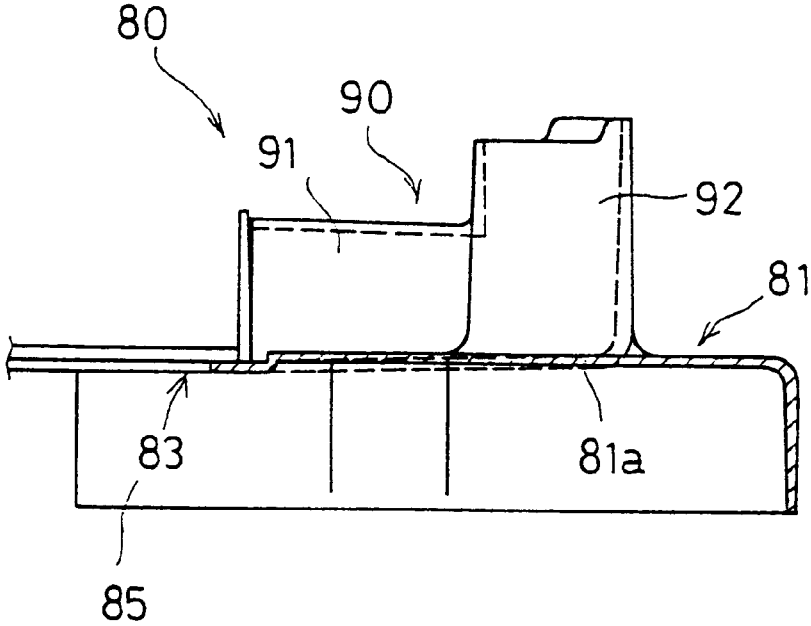
FIG. 10 is a sectional view taken on line X—X in FIG. 8.

The second cover 80 will be described with reference to FIGS. 8 to 10. As shown in FIGS. 8 and 9, the second cover 80 has a body 81 having the shape of a flat cover and consisting of a flat top wall 81*a* and a U-shaped side wall, a discharge duct 90 formed integrally with the body 81 and contiguous with a side extension wall extending from the right side (lower side as viewed in FIG. 8) of the top wall 81*a*, and a front extension wall 82 to be joined to the back extension wall 61 of the first cover 60. The side extension wall extending from the top wall 81*a* is stepped down relative to the top wall 81*a* by a distance corresponding to the wall thickness of the first cover 60. The U-shaped side wall defines a front open end of the second cover 80.

The discharge duct 90 is formed so as to lie in a vacant space outside a region in which the rotor 12*a* of the ac generator 12 rotates and extending under the combustion air inlet opening 18 formed in the upper rear portion of the cowling 5 and a hot air discharge opening 93 formed in a partition wall 93*a* when the first cover 60 and the second cover 80 are joined together and fastened to the engine block 8 of the engine 2 as shown in FIG. 1 The discharge duct 90 has a horizontal section 91 having a substantially square cross section and a vertical section 92 extending upright from the back end of the horizontal section 91. The upper end of the vertical section 92 is connected to the hot air discharge opening 93 having a substantially rectangular cross section as shown in FIG. 1.

A flange 91*a* is formed on the front end of the horizontal section 91. The front extension wall 82 is formed integrally with the body 81 so as to extend forward from the front edge of the body 81. The front extension wall 82 is joined to the back extension wall 61 of the first cover 60. As shown in FIGS. 8 and 9, the front extension wall 82 has a horizontal section 83, and a first vertical section 84 contiguous with one end (right end as viewed in FIG. 9) of the U-shaped side wall of the body 81. A step of a height corresponding to the wall thickness of the first cover 60 is formed between the body 81 and the front extension wall 82. As shown in FIG. 8, the horizontal section 83 has a shape substantially resembling the letter L in a plan view. A shorter portion 83*b* of the horizontal section 83, i.e., a portion corresponding to the shorter stroke of the letter L, has a greater width, includes the flange 91*a* formed on the front end of the horizontal section 91, extends from the inner side edge toward the outer side edge of a longer portion 83*a* of the horizontal section 83, i.e., a portion corresponding to the longer stroke of the letter L, and has an edge extending along the cylindrical body 64 of the first cover 60. When the first cover 60 and the second cover 80 are joined together, the shorter portion 83*b* is joined to the lower ends of the opposite side walls of the high section 61*b* of the first cover 60 to close the bottom of the open lower end of the high section 61*b* to form a discharge duct having a substantially square cross section. The shorter portion 83*b* is provided with three holes 88 arranged along its outer side and two holes 88 arranged along its inner side. The five latching projections 63 arranged in two rows on the first cover 60 engage in the holes 88, respectively.

The longer portion 83*a* of the horizontal section 83, i.e., the portion corresponding to the longer stroke of the letter L, is stepped down relative to the top wall 81*a* by a distance corresponding to the wall thickness of the first cover 60. The narrow longer portion 83*a* extends along the front edge of the top wall 81*a*. A recess 86 is formed in a middle portion of the longer portion 83*a*. Holes 87 in which the latching projections 62 of the first cover 60 engages are formed at positions on the opposite sides of the recess 86. The recess 86 provides a clearance for the bolt passed through the hole 69 formed in the middle portion of the low section 61*a* of the first cover 61*a* to pass. A second vertical section 85 extends from the other end (the left end as viewed in FIG. 9 and the lower end as viewed in FIG. 8) of the U-shaped side wall of the body 81. The second vertical section 85 extends along the inner side edge (shorter side edge) of the horizontal shorter portion 83*b*. The second vertical section 85 is not joined to the first cover 60. The second vertical section 85 guides hot air that flows from the space defined by the second cover 80 into the discharge duct 90 and hot air that flows below the closed passage A in the high section 61*b* into the space defined by the first cover 60 and flows toward the discharge duct 90.

Two radially extending lugs provided with holes 89 through which bolts are passed are formed in a back portion of the body 81 of the second cover 80. The second cover 80 is joined to the first cover 60 and is retained on a cylinder head cover 25 by fitting retaining projections 25*a* formed at two positions in the upper end of the cylinder head cover 25 in the holes 89 (FIG. 1). The second cover 80 may be fastened to the cylinder block 8 with bolts.

Figure 11:
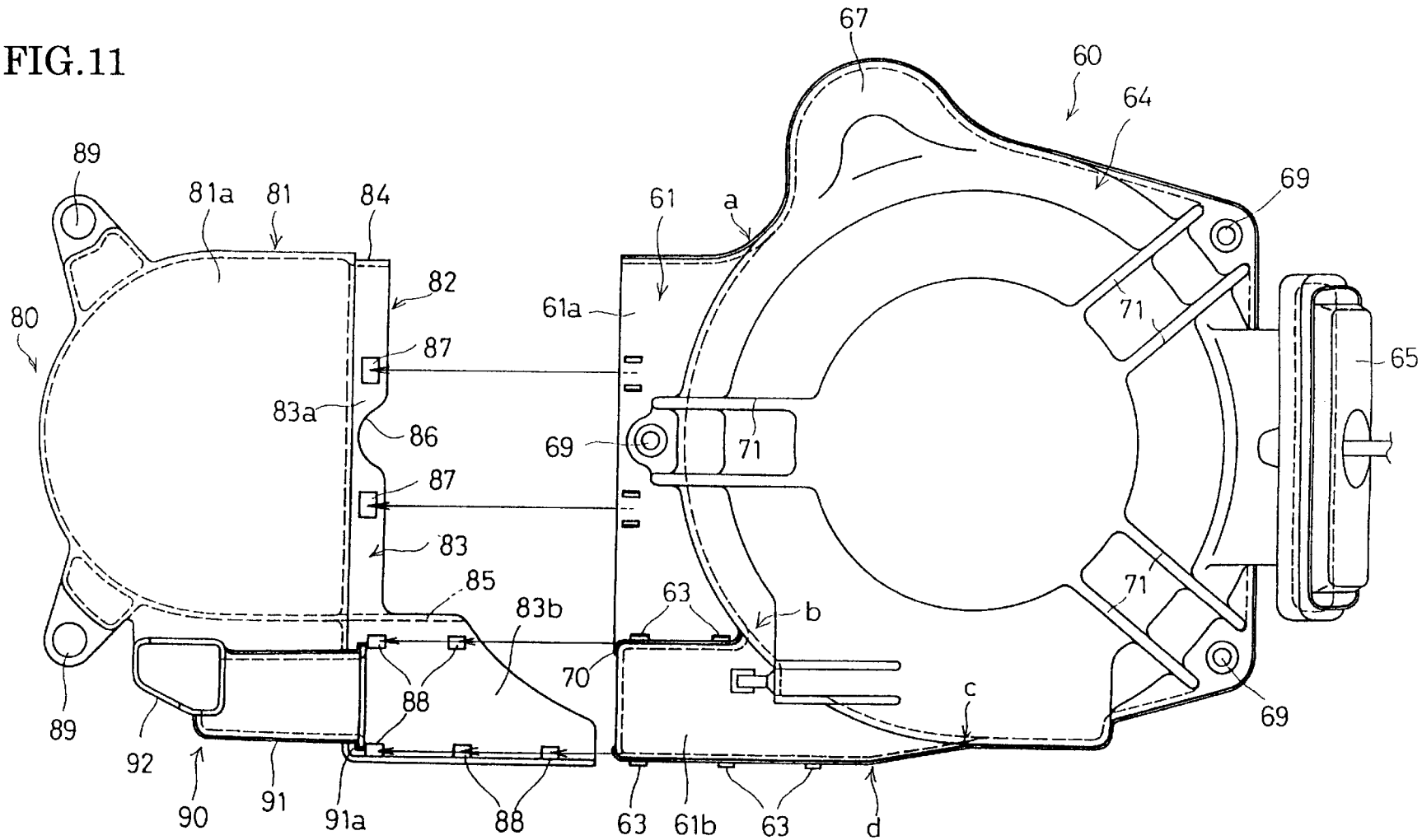
FIG. 11 is an exploded plan view of the ventilation cover structure shown in FIG. 2.
Figure 12:
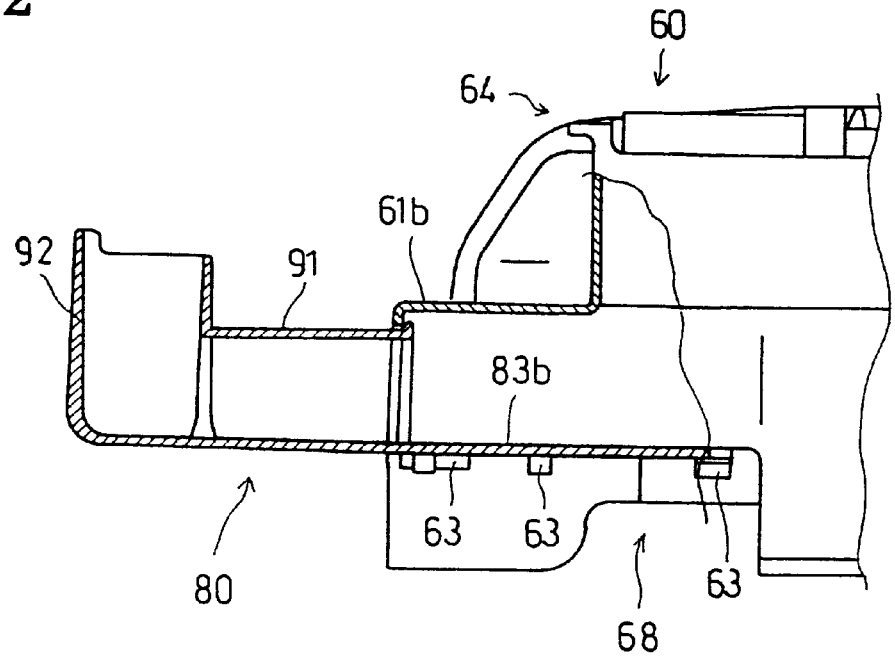
FIG. 12 is a sectional view taken on line XII—XII in FIG. 2.
Figure 13:
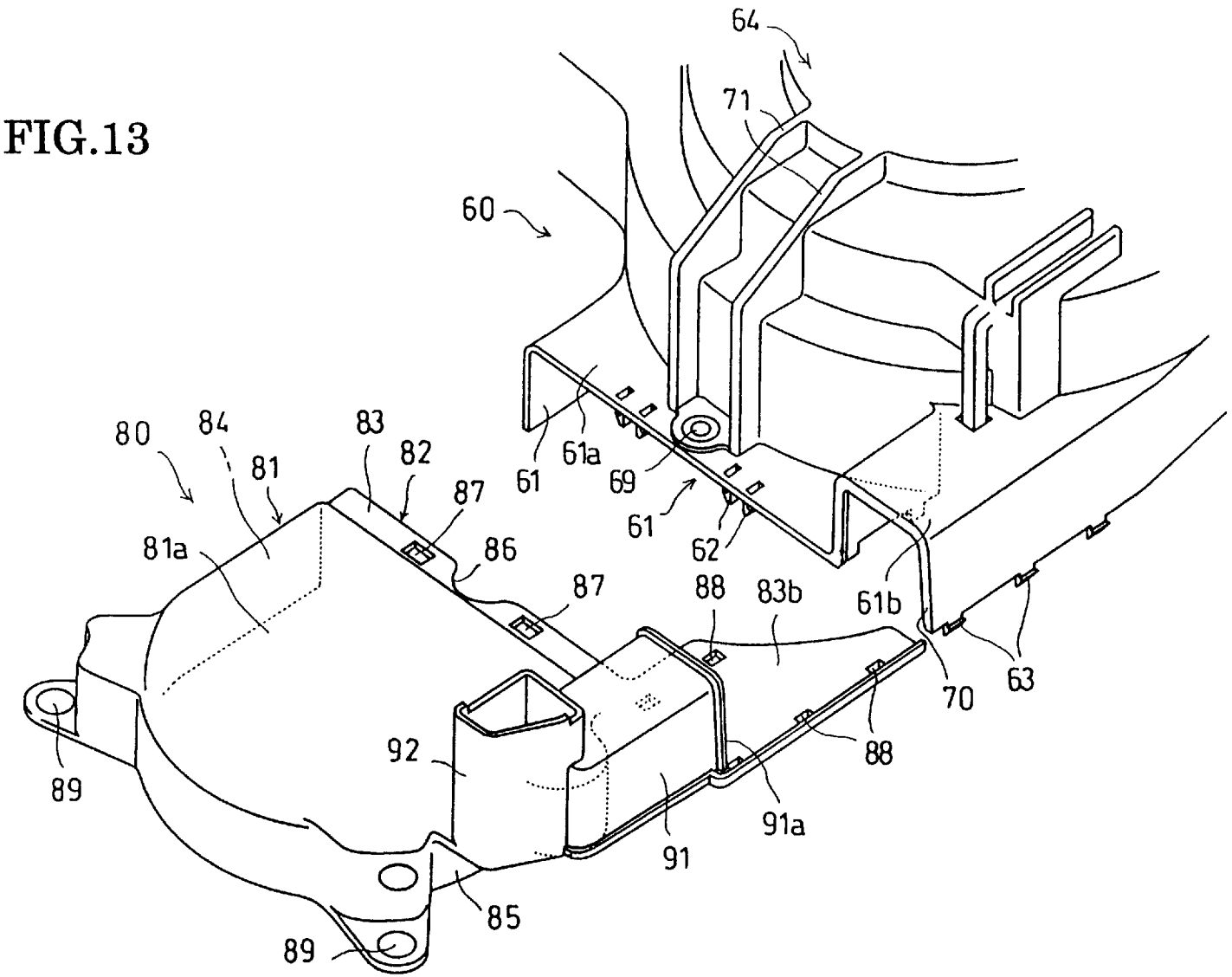
FIG. 13 is an exploded perspective view of the ventilation cover structure shown in FIG. 2.
Figure 14:
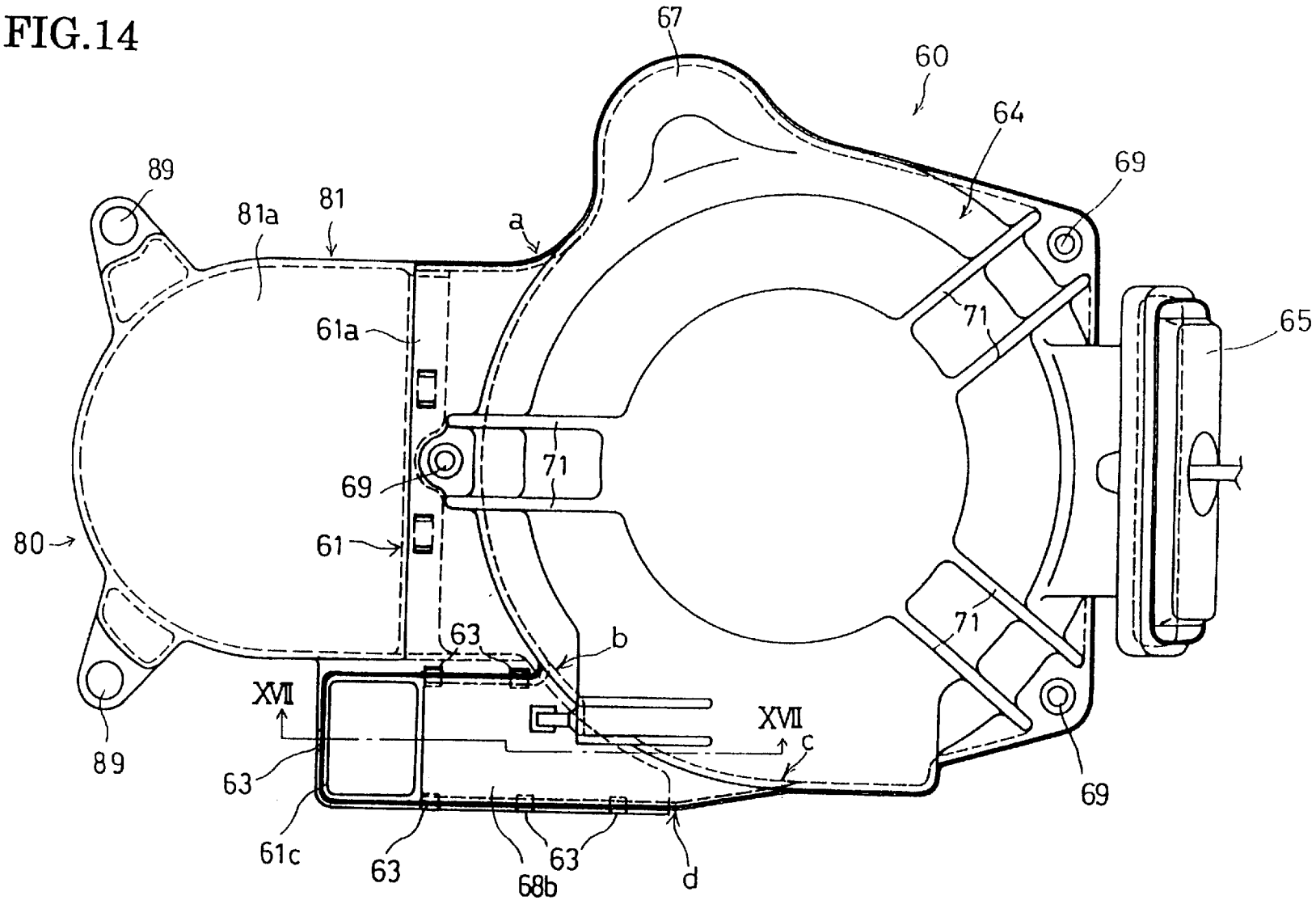
FIG. 14 is a plan view of a ventilation cover structure in a first modification of the ventilation cover structure shown in FIG. 2.

As shown in FIG. 11, the first cover 60 and the second cover 80 are placed with their open ends facing each other, and the front extension wall 82 of the back cover 80 is inserted in a space under the back extension wall 61 of the first cover 60. Then, the two latching projections of the first cover 60 are engaged in the two holes 87 of the second cover 80, and the five latching projections 63 of the first cover 60 arranged in two rows are engaged in the five holes 88 of the second cover 80 arranged in two rows, respectively, to join together the first cover 60 and the second cover 80. In this state, the back edge of the back extension wall 61 of the first cover 60 is in contact with the step formed between the body 81 and the extension wall 82 of the second cover 80. The inward curved brim 70 of the back end of the high section 61*b* of the first cover 60 (FIG. 3) is snapped on the flange 91*a* formed at the front end of the horizontal section 91 of the discharge duct 90 of the second cover 80 as shown in FIG. 2. The ventilation cover structure 50 thus assembled is fastened to the engine block 8 with bolts passed through the three holes 69 of the first cover 60 and the retaining projections 25*a* passed through the two holes 89 of the second cover 80. The ventilation cover structure 50 in this embodiment exercises the following functions and effects.

The first cover 60 of the ventilation cover structure 50 covers the crankshaft pulley 11, the ac generator 12 having the rotor 12*a* serving as a flywheel, and the recoil starter 13 arranged on the upper end portion of the crankshaft 7 projecting upward from the engine block 8, and opens downward. The second cover 80 of the ventilation cover structure 50 covers the camshaft pulley 16 mounted on the upper end portion of the camshaft 15 projecting upward from the engine block 8, and opens downward. The first cover 60 and the second cover 80 are joined together so that the spaces defined by them are connected in a single continuous space. The second cover 80 is provided with the discharge duct 90 having the lower wall extending on a level above that of the timing belt 17 in the region outside the space in which the rotor 12*a* of the ac generator 12 serving as a flywheel rotates. Therefore, hot air prevailing around the crankshaft pulley 11, the camshaft pulley 16, the timing belt 17, the ac generator 12 having the rotor 12*a* serving as a flywheel and the recoil starter 13 can be surely collected by the first cover 60 and the second cover 80, the hot air is forced to flow in the direction of rotation (clockwise direction in FIG. 2) of the rotor 12*a* and the timing belt 17. Thus, the hot air flows into the discharge duct 90 and is discharged outside through the hot air discharge opening 93. Similarly, hot air heated by the hot sidewalls of the engine block 8 can be surely collected first cover 60 and the second cover 80, which are opening downward, and is discharged outside. Thus, the engine room 6 can be satisfactorily ventilated and the output of the engine 2 can be enhanced.

Since the covers 60 and 80 open downward and the crank shaft pulley 11, the camshaft pulley 16, the ac generator 12 having the rotor 12*a* serving as a flywheel, and the recoil starter 13 are not covered from below, assembling work for attaching the ventilation cover structure 50 to the engine block 8 is simplified because it does not place any restriction on an assembling procedure for sequentially assembling those component parts of the engine 2 of the outboard engine 1.

The ventilation cover structure 50 of a resin or an alloy can be divided into the first cover 60 and the second cover 80, and the covers 60 and 80 can be formed by molding using relatively small molds, which enables the manufacture of the ventilation cover structure 50 at a low manufacturing cost.

Since the discharge duct 90 of the second cover 80 has the lower wall extending on a level above that of the timing belt 17 in the region outside the space in which the rotor 12*a* of the ac generator 12 serving as a flywheel rotates, the vacant space under the combustion air inlet opening 18 and the hot air discharge opening 93 can be effectively used for disposing the discharge duct 90 therein.

The first cover 60 and the second cover 80 can be easily joined together simply by engaging the plurality of latching projections 62 and 63 of the first cover 60 in the plurality of holes 87 and 88 of the second cover 80, respectively.

The engine 2 of the outboard engine 1 is provided with the recoil starter 13 disposed above the rotor 12*a* of the ac generator 12 mounted on the upper end portion of the crankshaft 7, and the ventilation cover structure 50 covers the recoil starter 13. In some cases, the engine 2 is not provided with the recoil starter 13.

In the embodiment shown in FIGS. 1 to 13, the discharge duct 90 of the second cover 80 is connected to the back end of a discharge duct formed of the high section 61*b* of the first cover 60 and the shorter portion 83*b* of the horizontal section 83 of the second cover 80.

A ventilation cover structure in a first modification of the ventilation cover structure in the first embodiment will be described with reference to FIGS. 14 to 17, in which parts like or corresponding to those shown in FIGS. 1 to 13 are denoted by the same reference characters and the description thereof will be omitted. The ventilation cover structure in the first modification is provided with a discharge duct different from that of the ventilation cover structure 50 in the first embodiment.

Figure 15:
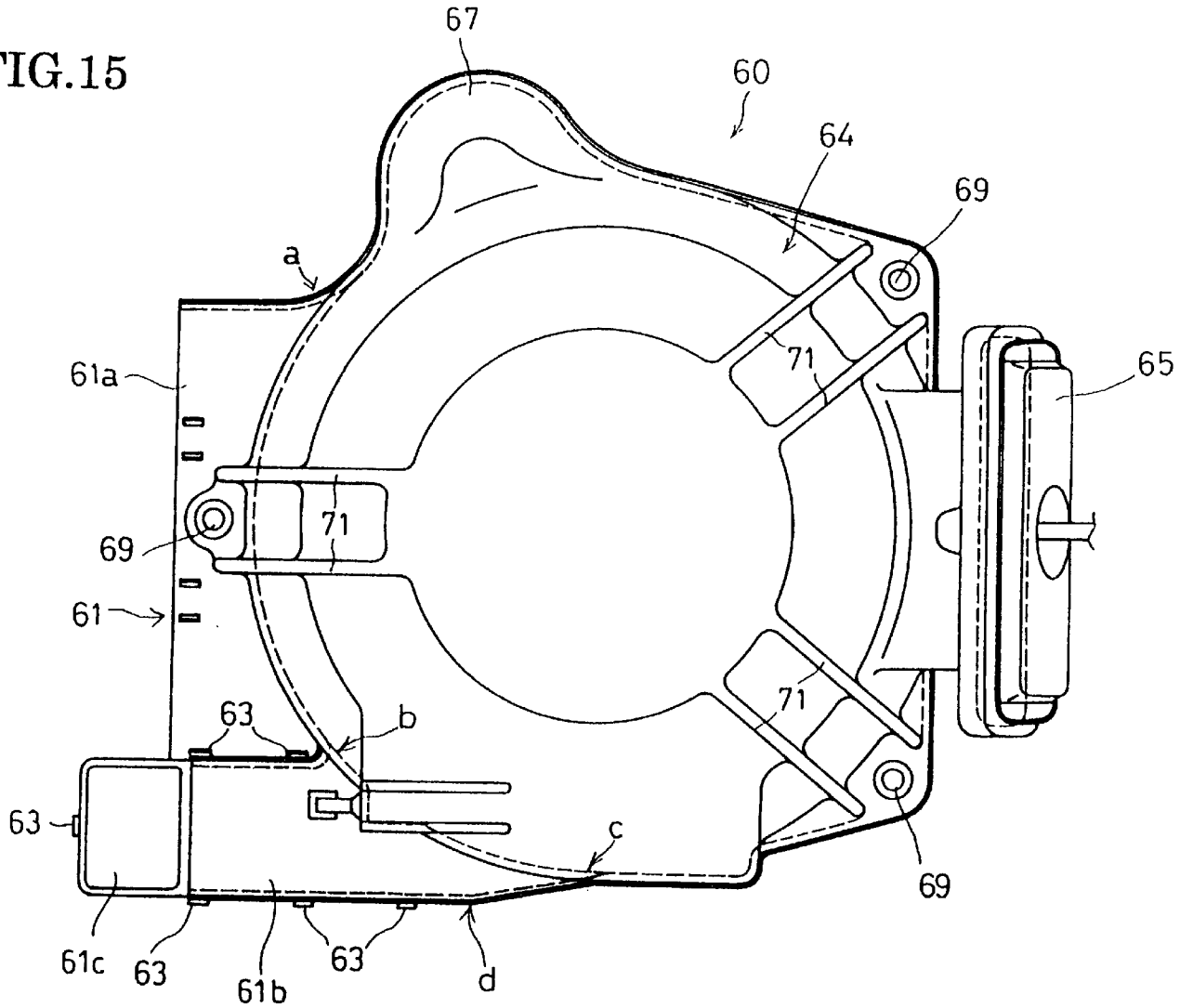
FIG. 15 is a plan view of a first cover included in the ventilation cover structure shown in FIG. 14.
Figure 16:
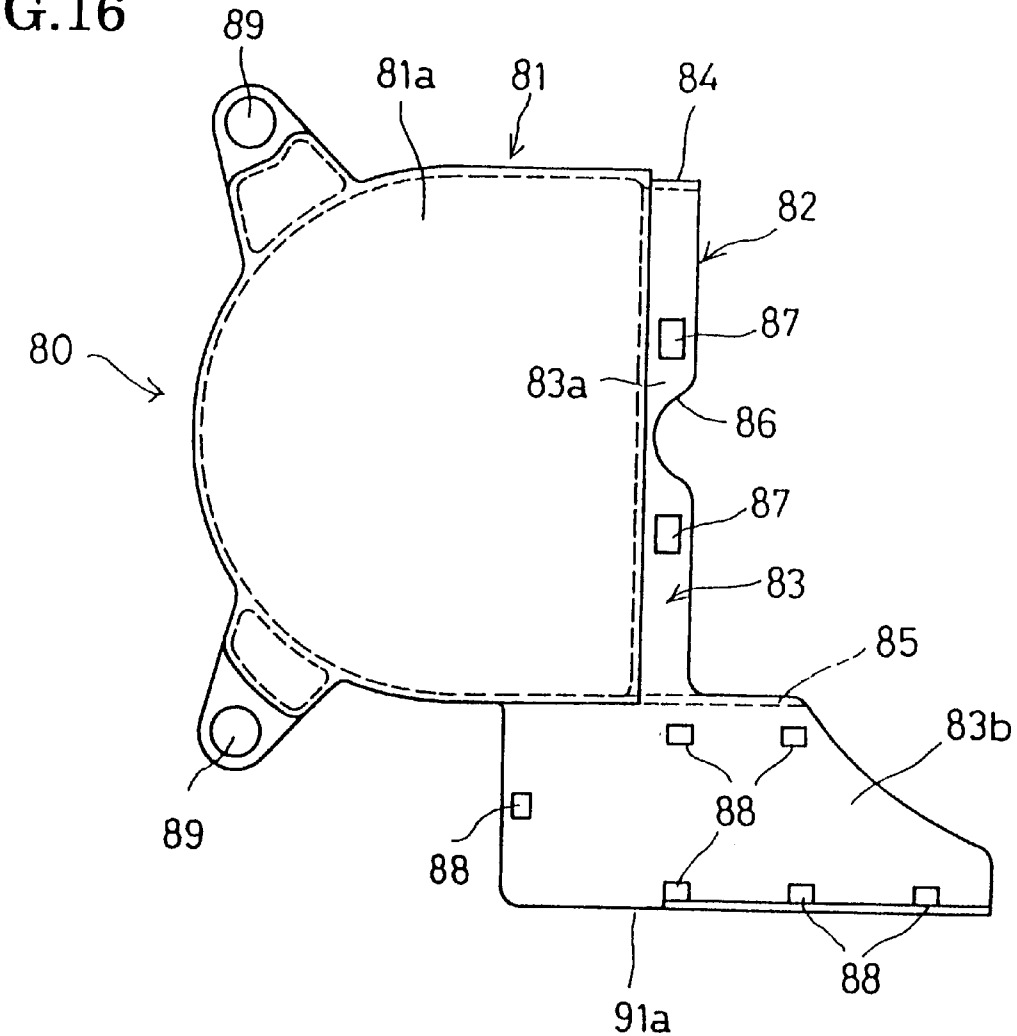
FIG. 16 is a plan view of a second cover included in the ventilation cover structure shown in FIG. 14.
Figure 17:
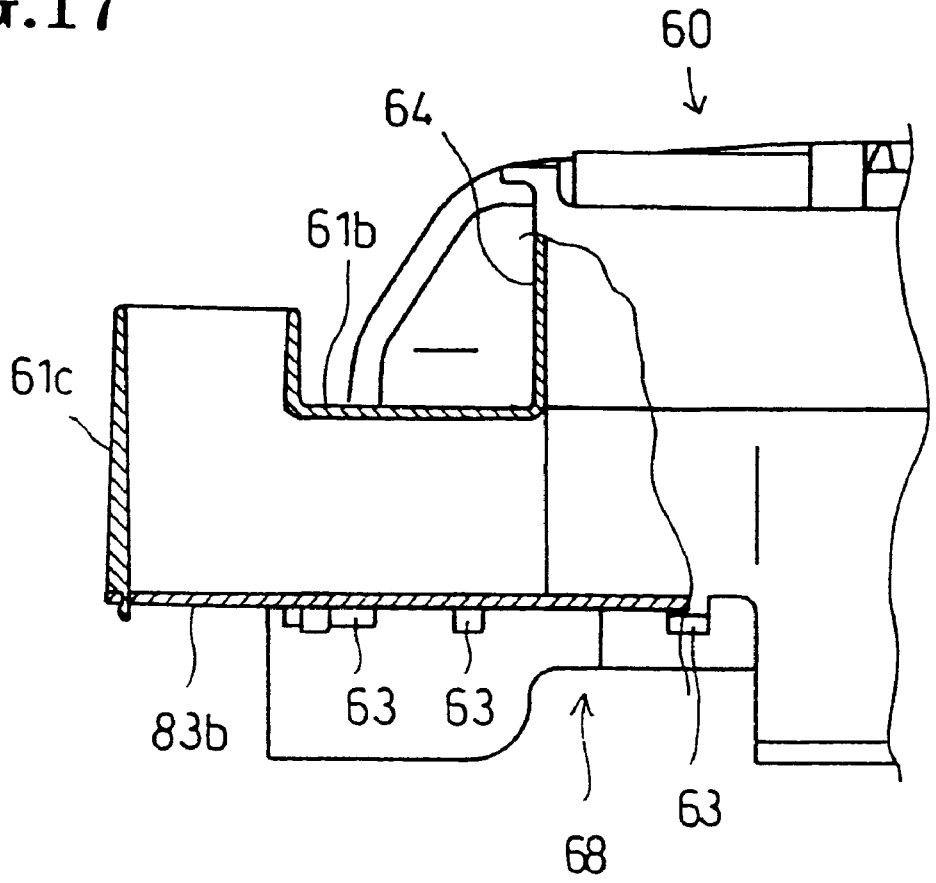
FIG. 17 is a sectional view taken on line XVII—XVII in FIG. 14.

As shown in FIG. 15, a bottomless vertical duct 61*c* is connected to the back end (left end in FIG. 15) of a high section 61*b* of a first cover 60. As shown in FIG. 16, a shorter portion 83*b* of a horizontal section 83 of a second cover 80 is extended backward by a length slightly greater than the width, i.e., the size with respect to a longitudinal direction, of the vertical duct 61*c*. The second cover 80 is not provided with any portions corresponding to the horizontal section 91 and the vertical section 92 as are in the second cover of the embodiment of FIGS. 1–13. A latching projection 63 projects from the lower edge of the back wall of the vertical duct 61*d* and a hole 88 is formed in the shorter portion 83*b* at a position near the back edge of the same. Thus, the duct communicating with the spaces covered with the first cover 60 and the second cover 80 is formed in a space outside a region where the rotor 12*a* of an ac generator 12 rotates. The effect of the ventilation cover structure in the second embodiment is the same as that of the ventilation cover structure in the first embodiment.

A ventilation cover structure in a second modification of the ventilation cover structure in the first embodiment will be described with reference to FIGS. 18 and 19, in which parts like or corresponding to those shown in FIGS. 1 to 13 are denoted by the same reference characters and the description thereof will be omitted.

Figure 18:
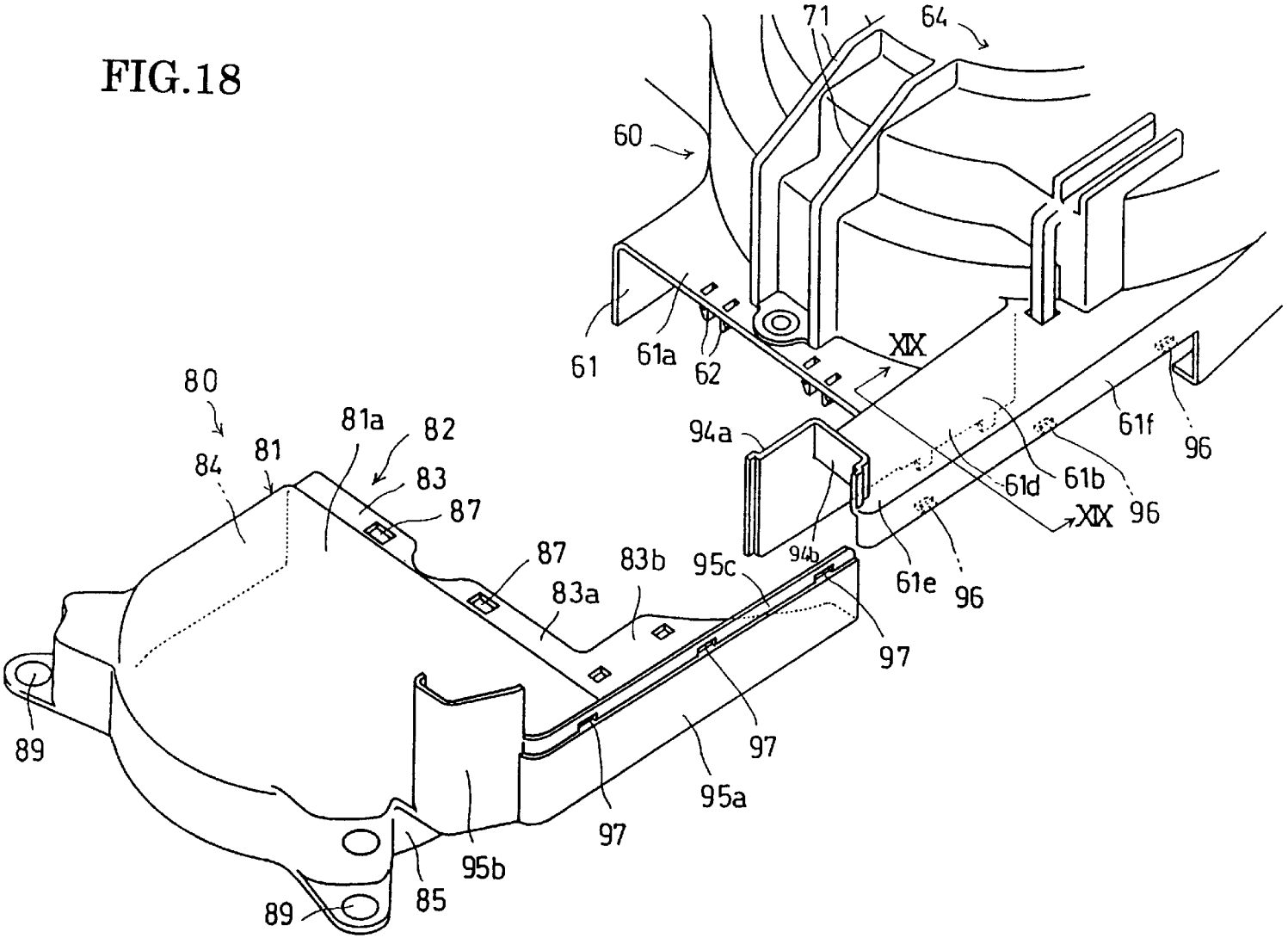
FIG. 18 is an exploded perspective view of a ventilation cover structure in a second modification of the ventilation cover structure shown in FIG. 2.
Figure 19:
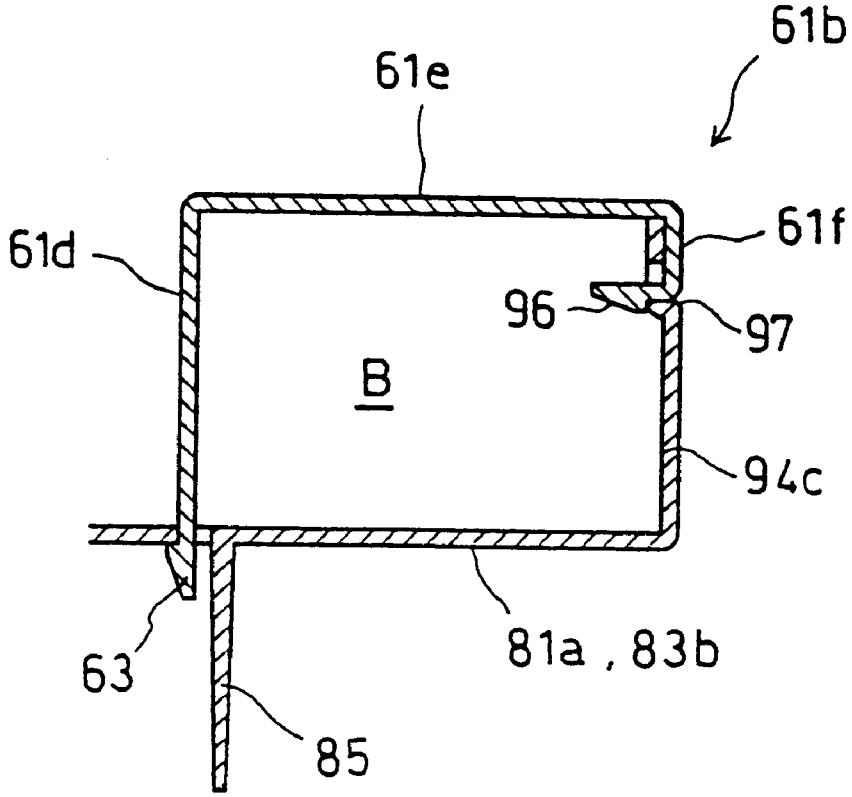
FIG. 19 is a sectional view taken on line XIX—XIX in FIG. 18.

Referring to FIGS. 18 and 19, an inner side wall 61*d* and a top wall 61*d* of a high section 61*b* of a back extension wall 61 of a first cover 60, a flat top wall 81*a* of a second cover 80, and a shorter portion 83*b* of a horizontal section 83 of a front extension wall of the second cover 80, and an outer side wall 95*a* of the second cover 80 form a horizontal section B of a discharge duct for discharging hot air outside. A vertical inner wall 94*a* and a vertical front wall 94*b* of the first cover 60, and a vertical back wall 95*b* of the second cover 80 form a vertical section, not shown in the assembled state, of the discharge duct. Hot air collected by the first cover 60 and the second cover 80 is discharged smoothly outside through the discharge duct having the horizontal section B and the vertical section, and a hot air discharge opening 93.

The ventilating cover structure in the second modification can be divided into the first cover 60 having open lower and back ends and the second cover 80 having open lower and front ends. The first cover 60 and the second cover 80 can be formed by molding using split molds that can be split along a parting face into an upper and a lower half mold. Thus the first cover 60 and the second cover 80 can be produced by a simple molding process at a very low cost.

Figure 20:
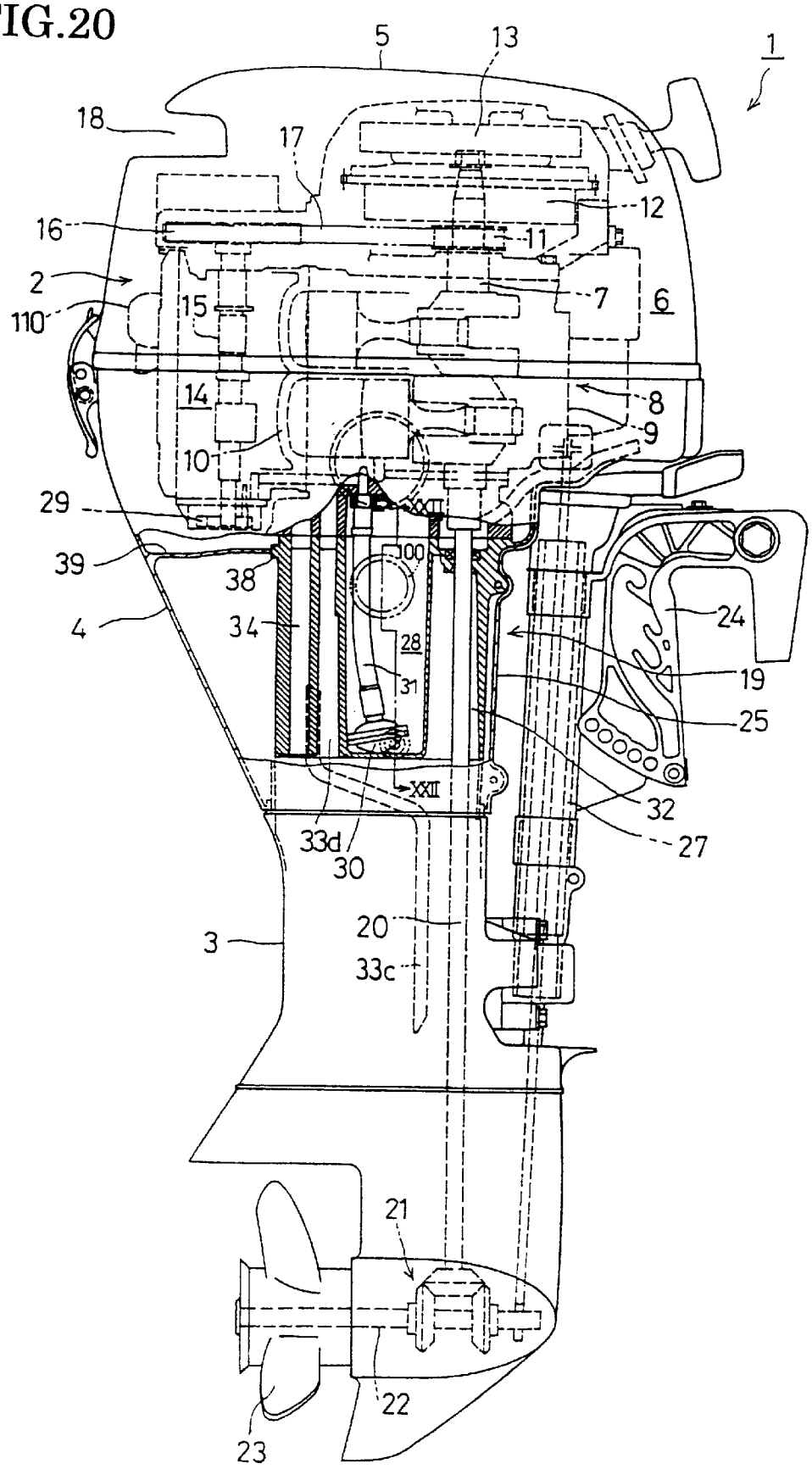
FIG. 20 is a partly cutaway side elevation of an outboard engine in a second embodiment according to the present invention.

An outboard engine in a second embodiment according to the present invention may be provided with an oil case 19 shown in FIGS. 20 to 24. The oil case 19 has a body 25 provided with a central oil reservoir 28, and a support arm 26 extending obliquely upward toward the front (obliquely rightward as viewed in FIGS. 21 and 22) from a front part of the upper brim of the body 25. The support arm 26 bears part of the weight of an engine 2 and supports an upper end part of a swivel shaft 27 (FIG. 20). The oil reservoir 28 has an open upper end and is formed in the shape of an elongated, deep, flat cup extending in a direction perpendicular to the paper as viewed in FIGS. 20 and 21. The length of a lower half of the oil reservoir 28 is about half the entire length of the oil reservoir 28.

Figure 21:
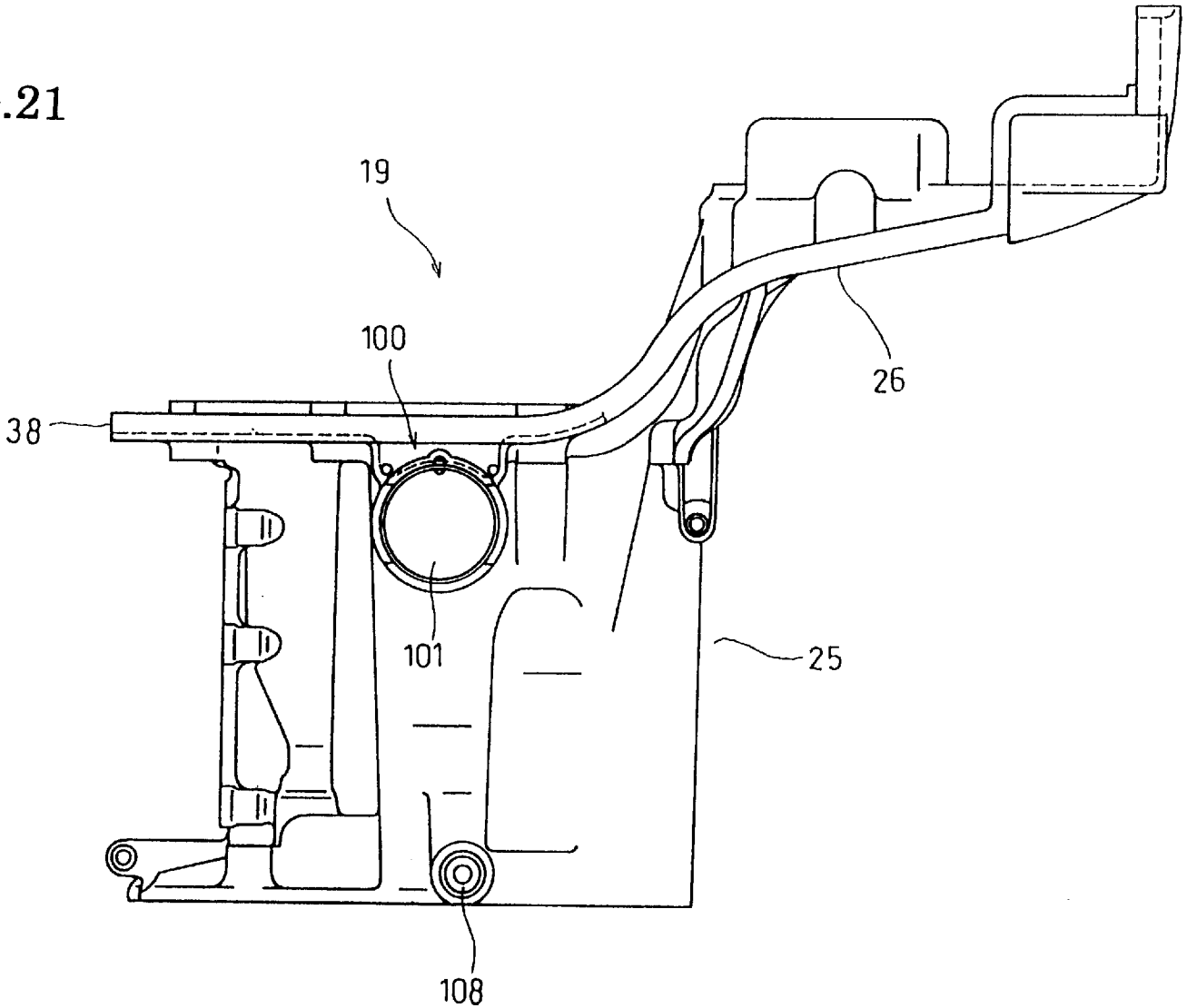
FIG. 21 is a side elevation of an oil case.
Figure 22:
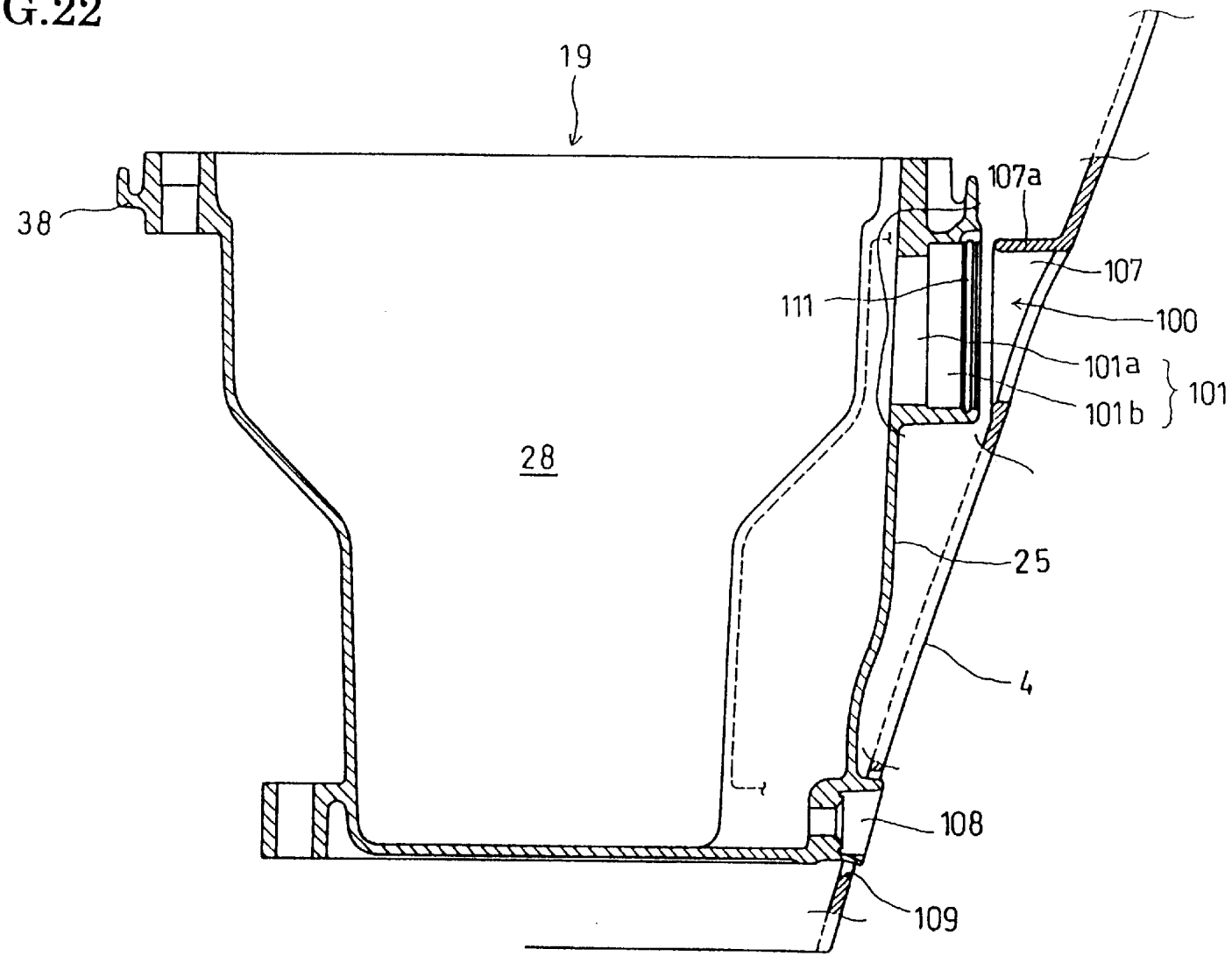
FIG. 22 is a sectional view taken on line XXII—XXII in FIG. 20.
Figure 23:
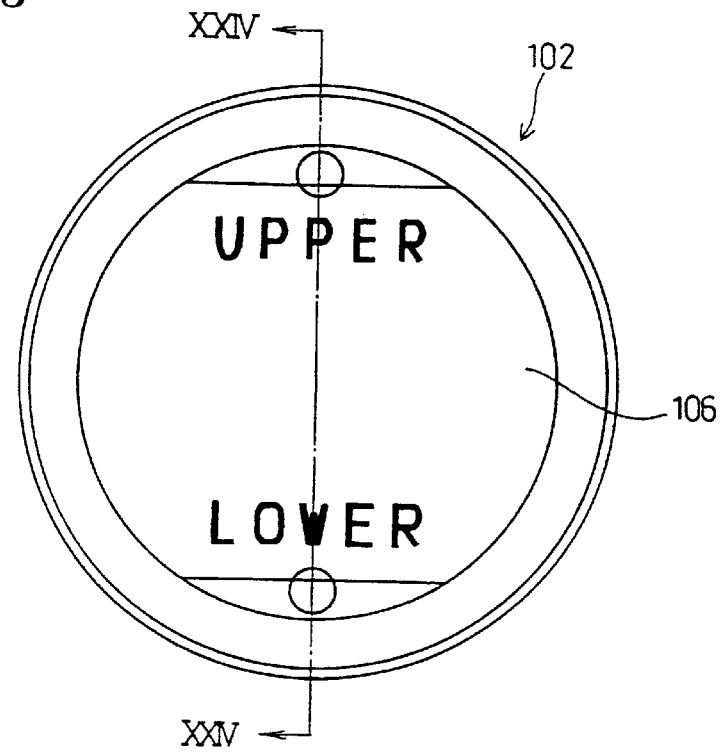
FIG. 23 is a front elevation of a plug for closing an opening for an oil level gage.
Figure 24:
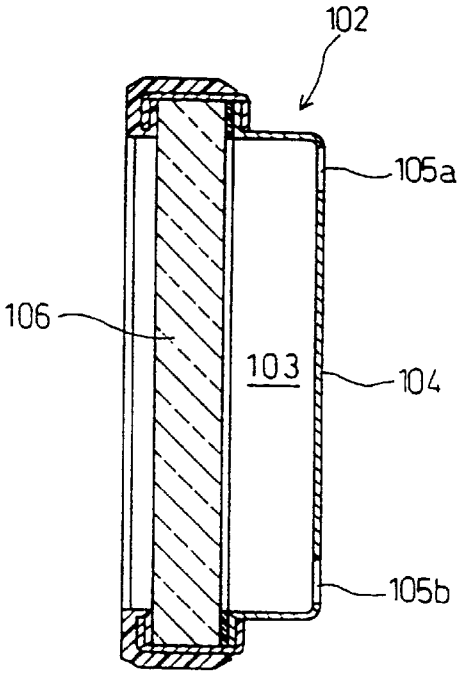
FIG. 24 is a sectional view taken on line XXIV—XXIV in FIG. 23.

As shown in FIGS. 21 and 22, an opening 101 for forming an oil level inspecting window 100 is formed in a right side wall (a side wall shown in FIG. 21) of the oil reservoir 28 at a position near the upper end of the oil reservoir 28. The opening 101 consists of an inner section 101*a* of a relatively small diameter opening into the reservoir 28 and an outer section 101*b* of a relatively large diameter opening toward a lower, narrow part of an under cover 4. A transparent plug 102 (FIGS. 23 and 24) having a small part and a large part respectively corresponding to the inner section 101*a* and the outer section 101*b* is fitted in the opening 101 in a liquid-tight fashion. The small part of the transparent plug 102 has an oil chamber 103 defined by a wall 104. The oil chamber

103 communicates with the interior of the oil reservoir 28 by means of holes 105*a* and 105*b* formed in upper and lower parts, respectively, of the wall 104. A transparent plate 106 is sealed in a liquid-tight fashion in the large part of the transparent plug 102. The transparent plate 106 defines, together with the wall 104, the oil chamber 103. The transparent plug 102 is fitted in a liquid-tight fashion in the opening 101 and a snap ring, not shown, is fitted in a circular groove 111 formed in the circumference of the outer section 101*b* to retain the transparent plug 102 in place.

The oil contained in the oil reservoir 28 flows into the oil chamber 103. The level of the oil in the oil reservoir 28 can be known from the level of the oil in the oil chamber 103 which can be seen through the transparent plate 106. An upper limit line with letters "UPPER" indicating an upper limit level of the oil and a lower limit line with letters "LOWER" indicating a lower limit level of the oil are marked on the outer surface of the transparent plate 106.

An opening 107 is formed in the lower, narrow part of the under cover 4 so as to coincide with the oil level inspecting window 100 as shown in FIG. 22. The oil level inspecting window 100 can be seen through the opening 107. The under cover 4 is provided with a short, cylindrical wall 107*a* extending inward from the brim of the opening 107. Since the oil level inspecting window 100 is located near the relatively high upper end of the oil reservoir 28, the opening 107 of the under cover 4 is formed in a middle part of the under cover 4. The cylindrical wall 107*a* reinforces the relatively thin brim of the opening 107 to suppress noise generated by the chattering of the under cover 4 caused by the vibration of the engine. The user of the outboard engine 1 is able to look at the oil level inspecting window 100 through the opening 107 to recognize the level of the oil in the oil reservoir 28. The oil reservoir 28 does not need to be replenished with oil when the level of the oil in the oil reservoir 28 is at a position between the upper limit line "UPPER" and the lower limit line "LOWER". If the level of the oil in the oil reservoir 28 is below the lower limit line "LOWER", the oil reservoir 28 is replenished with oil. When replenishing the oil reservoir 28 with oil, the oil is supplied through, for example, an oil filler port 110 formed in a cowling 5 covering the engine 2. As shown in FIGS. 21 and 22, an oil drain port 108 is formed in a part of the right side wall (the wall shown in FIG. 21) at a position near the lower end of the oil reservoir 28 of the oil case 19. The oil drain port 108 is dislocated slightly from a position directly below the oil level inspecting window 100. The oil is drained from the oil reservoir 28 through the oil drain port 108. An opening 109 is formed in the lower, narrow part of the under cover 4 so as to coincide with the oil drain port 108. A substantially cylindrical wall formed at the brim of the drain port 108 projects into the opening 109. Therefore, a plug, not shown, closing the oil drain port 108 can be removed from outside the under cover 4.

The second embodiment exercises the following effects.

In the outboard engine 1 in the second embodiment, the oil level inspecting window 100 for inspecting the level of the oil for lubricating the engine 2 in the oil reservoir 28 is formed in the side wall of the oil reservoir 28 of the oil case 19 underlying the engine block 8 of the engine 2, and the opening 107 through which the oil level inspecting window 100 is looked at is formed in the narrow lower part of the under cover 4 so as to coincide with the oil level inspecting window 100. Therefore, the oil level inspecting window 100 can be looked at from outside the under cover 4 through the opening 107 formed in the under cover 4 to inspect the level of the oil in the oil reservoir 28 without opening the cowling 5. Thus, the inspection of the level of the oil in the oil reservoir 28 can be very simply achieved.

Since the opening 107 is formed in the lower narrow part of the under cover 4, the part of the under cover 4 provided with the opening 107 is close to the side wall of the oil reservoir 28 of the oil case 19, the oil level inspecting window 100 can be looked at through the opening 107 without using any additional image transmitting means capable of a telescopic function or a light guiding function, which reduces the number of component parts and costs of the outboard engine.

The cylindrical wall 107*a* extending inward from the brim of the opening 107 and formed at a position corresponding to the oil level inspecting window 100 enhances the rigidity of the under cover 4, so that noise generated by the chattering of the under cover 4 caused by the vibration of the engine can be suppressed.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A ventilation cover structure for an outboard engine provided with: a four-stroke cycle engine having an engine block, a vertical crankshaft having an upper end portion projecting upward from the engine block, a vertical camshaft having an upper end portion projecting upward from the engine block, a belt-drive transmission including a camshaft driving pulley mounted on the upper end portion of the crankshaft, a camshaft pulley mounted on the upper end portion of the camshaft, and a belt extended between the camshaft driving pulley and the camshaft pulley to interlock the crankshaft and the camshaft, and a flywheel disposed above the camshaft driving pulley and mounted on the upper end portion of the crankshaft; and engine covers defining an engine room in which the four-stroke cycle engine is disposed, said ventilation cover structure comprising:

a first cover for placement above the engine block so as to cover at least the flywheel and opening downward; and a second cover for placement above the engine block so as to cover a space extending over a portion of the engine block including the camshaft and opening downward;

wherein when the first and the second covers are joined together and placed above the engine block, spaces covered with the first and the second covers are united in a single space, and sections of the first and the second covers lying outside a space occupied by the flywheel jointly form a discharge duct defining a space communicating with the single space covered with the first and the second covers.

2. The ventilation cover structure according to claim 1, wherein the first cover is provided integrally with a channel-shaped structure of a cross section with a shape resembling an inverted letter U having an open lower end and which lies in a region outside the space occupied by the flywheel when placed above the engine block, and the open lower end of the channel-shaped structure is closed by a portion of the second cover when the first and the second covers are joined together.

3. The ventilation cover structure according to claim 1, wherein the first cover is provided with a back extension wall extending toward the second cover and having a low, flat, horizontal section, a vertical side wall rising from one end of the horizontal section, and a horizontal top wall horizontally extending from the upper end of the vertical side wall; the second cover is provided with a front extension wall extending toward the first cover and having a low, flat, horizontal bottom wall extending directly under the top wall of the first cover, and a vertical side wall rising from an outer edge of the bottom wall; and the vertical side wall and the horizontal top wall of the first cover, and the horizontal bottom wall and the vertical side wall of the second cover form a discharge duct when the first and the second cover are joined together.

4. The ventilation cover structure according to claim 1, wherein the first and second covers entirely cover an upper end of the engine when placed above the engine block.

5. The ventilation cover structure according to claim 1, wherein the first cover also is provided with an air inlet.

6. The ventilation cover structure according to claim 1, wherein the first cover has a substantially inverted round bowl shape.

7. The ventilation cover structure according to claim 1, wherein the first and second covers are adapted to be fixed to the engine.

8. The ventilation cover structure according to claim 1, wherein the first and second covers are provided with latching projections and mating openings which securely receive the latching projections when the first and second covers are joined together.

9. The ventilation cover structure according to claim 1, wherein the discharge duct includes a horizontally extending portion which receives air discharged from the single space covered with the first and second covers, and a vertically extending portion which receives air from the horizontally extending portion and discharges the air upwardly.

10. The ventilation cover structure according to claim 1, wherein the first and second covers are joined together along respective, substantially flat end faces thereof.

11. A ventilation cover structure for an outboard engine provided with: a four-stroke cycle engine having an engine block, a vertical crankshaft and a vertical camshaft having upper end portions projecting upward from the engine block, a belt-drive transmission including a belt extended between the crankshaft and the camshaft, and a flywheel disposed above the camshaft driving pulley and mounted on the upper end portion of the crankshaft; and engine covers defining an engine room in which the four-stroke cycle engine is disposed, said ventilation cover structure comprising:

a first cover for placement above the engine block so as to cover at least the flywheel and opening downward; and a second cover for placement above the engine block so as to cover a portion of the engine block including the camshaft and opening downward;

wherein when the first and the second covers are fixed together and placed above the engine block, the covers define a single space covering substantially the entire engine, and sections of the first and the second covers lying outside a space occupied by the flywheel jointly form a discharge duct defining a space communicating with the single space covered with the first and the second covers.

12. The ventilation cover structure according to claim 11, wherein the first and second covers entirely cover an upper end of the engine when placed above the engine block.

13. The ventilation cover structure according to claim 11, wherein the first cover also is provided with an air inlet.

14. The ventilation cover structure according to claim 11, wherein the first cover has a substantially inverted round bowl shape.

15. The ventilation cover structure according to claim 11, wherein the first and second covers are adapted to be fixed to the engine.

16. The ventilation cover structure according to claim 11, wherein the first and second covers are provided with latching projections and mating openings which securely receive the latching projections when the first and second covers are joined together.

17. The ventilation cover structure according to claim 11, wherein the discharge duct includes a horizontally extending portion which receives air discharged from the single space covered with the first and second covers, and a vertically extending portion which receives air from the horizontally extending portion and discharges the air upwardly.

18. The ventilation cover structure according to claim 11, wherein the first and second covers are joined together along respective, substantially flat end faces thereof.

* * * * *

UNITED STATES PATENT AND TRADEMARK OFFICE

CERTIFICATE OF CORRECTION

PATENT NO. : 6,428,373 B2 
DATED : August 6, 2002
INVENTOR(S) : Tomonori Ikuma and Hiroyuki Yoshida It is certified that error appears in the above-identified patent and that said Letters Patent is hereby corrected as shown below:

Title page,
Item [56], References Cited, U.S. PATENT DOCUMENTS, for reference "5,683,277" change "440/80" to -- 440/88 --.

Column 1,
Line 37, change "by stagnating" to -- air stagnating --.
Line 58, change "to specifically" to -- specifically to --.

Column 4,
Line 16, change "is corresponds" to -- corresponds --.
Line 62, change "born" to -- borne --.

Column 5,
Line 7, change "crank shaft" to -- crankshaft --.
Line 38, change "an discharge" to -- a discharge --.
Line 44, change "39," to -- 39 and --.
Line 46, change "39 and" to -- 39, --.

Column 6,
Line 37, change "sidewall" to -- side wall --.
Line 54, change "there coil" to -- the recoil --.
Line 66, change "outersurface" to -- outer surface --.

Column 9,
Line 7, change "sidewalls" to -- side walls --.
Line 8, after "collected" insert -- by the --.
Line 12, after "crank" insert a hyphen.

Signed and Sealed this

Fifteenth Day of April, 2003

JAMES E. ROGAN
*Director of the United States Patent and Trademark Office*